US005283963A

United States Patent [19]

Lerner et al.

[11] Patent Number: 5,283,963

[45] Date of Patent: Feb. 8, 1994

[54] SOLE FOR TRANSFERRING STRESSES FROM GROUND TO FOOT

[76] Inventors: Moisey Lerner, 75 Rolling La., Needham, Mass. 02192; Leonid Dabuzhsky, 86 High Rock Ter., Newton, Mass. 02167

[21] Appl. No.: 795,690

[22] Filed: Nov. 21, 1991

Related U.S. Application Data

[63] Continuation-in-part of Ser. No. 395,368, Aug. 17, 1989, abandoned, which is a continuation-in-part of Ser. No. 138,957, Dec. 29, 1987, abandoned, which is a continuation-in-part of Ser. No. 106,152, Oct. 8, 1987, abandoned.

[51] Int. Cl.[5] ..... A43B 13/20

[52] U.S. Cl. ..... 36/28; 36/29

[58] Field of Search ..... 36/28, 29, 1 R, 35 B, 36/37, 30 R; 5/450, 451, 452, 464, 474, 449, 348; 267/143, 140.1 A, 113, 117, 97

[56] References Cited

U.S. PATENT DOCUMENTS

| | | | |
|---|---|---|---|
| 1,089,036 | 3/1914 | Bartels | 36/77 R |
| 1,545,437 | 7/1925 | Malone et al. | 36/7.8 |
| 1,640,618 | 8/1927 | Sampson | 267/117 |
| 1,771,746 | 7/1930 | Clifford | 36/77 R |
| 1,795,304 | 3/1931 | Howard | 267/117 |
| 1,942,883 | 1/1934 | Schaffer | 36/29 |
| 2,077,121 | 4/1937 | Lovell | 36/77 R |
| 2,677,906 | 5/1954 | Reed | 36/71 |
| 2,740,209 | 4/1956 | Shultz | 36/77 R |
| 2,756,519 | 7/1956 | Hill | 36/77 R |
| 3,120,712 | 2/1964 | Menken | 36/29 |
| 3,253,355 | 5/1966 | Menken | 36/29 |
| 3,270,358 | 9/1966 | Milner | 36/77 R |
| 3,606,296 | 9/1971 | Chassagne | 267/113 |
| 3,702,484 | 11/1972 | Tobinick | 5/348 |
| 3,748,669 | 7/1973 | Warner | 5/348 |
| 3,787,908 | 1/1974 | Beck | 5/348 |
| 4,005,531 | 2/1977 | Weintraub et al. | 36/28 |
| 4,008,530 | 2/1977 | Gager | 36/28 |
| 4,012,854 | 3/1977 | Berend et al. | 36/29 |
| 4,016,662 | 4/1977 | Thompson | 36/29 |
| 4,073,021 | 2/1978 | Carlisle | 5/365 |
| 4,100,686 | 7/1978 | Sgarlato et al. | 36/29 |
| 4,106,222 | 8/1978 | Hovck | 36/29 |
| 4,115,934 | 9/1978 | Hall | 36/29 |
| 4,129,951 | 12/1978 | Petrosky | 36/29 |
| 4,170,078 | 10/1979 | Moss | 36/29 |
| 4,219,945 | 9/1980 | Rudy | 36/29 |
| 4,223,457 | 9/1980 | Borgeas | 36/35 B |
| 4,227,320 | 10/1980 | Borgeas | 36/29 |

(List continued on next page.)

FOREIGN PATENT DOCUMENTS

| | | | |
|---|---|---|---|
| 352216 | 4/1922 | Fed. Rep. of Germany | 36/29 |
| 2460034 | 6/1976 | Fed. Rep. of Germany | 36/29 |
| 1007060 | 4/1952 | France | 36/29 |
| 1011213 | 6/1952 | France | 36/29 |
| 2508778 | 1/1983 | France | 36/29 |
| 2591441 | 6/1987 | France | 36/29 |
| 8911047 | 11/1989 | PCT Int'l Appl. | 30/28 |
| 792034 | 3/1958 | United Kingdom | 36/28 |

*Primary Examiner*—Steven N. Meyers
*Attorney, Agent, or Firm*—Weingarten, Schurgin, Gagnebin & Hayes

[57] ABSTRACT

A shoe sole comprising a case having a liquid-filled chamber which isostatically redistributes pressure on the weight-bearing portion of the foot is disclosed. The pressure created in the liquid-filled chamber is applied against the peripheral wall of the chamber. A first portion of the peripheral wall is able to buckle and store energy when the foot pushes against the ground and to release the stored energy, spring-like, into the liquid-filled chamber when the foot moves from the ground. The remainder of the peripheral wall does not buckle at pressure levels at which the first portion buckles, thereby protecting the sole from a sliding phenomenon which would cause structural instability of the sole while buckling. A force magnifying or dividing ability may also be provided by forming the surface of the chamber bottom with an area which differs from the area of the surface of the chamber ceiling which is in immediate contact with the weight-bearing surface of the foot.

27 Claims, 17 Drawing Sheets

U.S. PATENT DOCUMENTS

| | | | |
|---|---|---|---|
| 4,229,889 | 10/1980 | Petrosky | 36/28 |
| 4,301,560 | 11/1981 | Fraige | 5/450 |
| 4,325,152 | 4/1982 | Carpenter | 5/450 |
| 4,330,893 | 5/1982 | Matsui | 5/452 |
| 4,458,430 | 7/1984 | Peterson | 36/29 |
| 4,462,171 | 7/1984 | Whispell | 36/29 |
| 4,501,035 | 2/1985 | Hall | 5/451 |
| 4,567,677 | 2/1986 | Zona | 36/28 |
| 4,571,762 | 2/1986 | Rhoton et al. | 5/474 |
| 4,577,357 | 3/1986 | Hall | 5/451 |
| 4,627,121 | 10/1986 | Winther | 5/451 |
| 4,670,995 | 6/1987 | Huang | 36/29 |
| 4,676,009 | 6/1987 | Davis et al. | 36/29 |
| 4,768,295 | 9/1988 | Ito | 36/28 |
| 4,774,776 | 10/1988 | Gulli | 36/7.8 |
| 4,799,277 | 1/1989 | Goodale | 5/474 |
| 4,829,682 | 5/1989 | Gasbarro | 36/29 |
| 4,864,737 | 9/1989 | Marrello | 36/28 |
| 5,010,662 | 4/1991 | Dabuzhsky et al. | 36/29 |

SOLE FOR TRANSFERRING STRESSES FROM GROUND TO FOOT

RELATED APPLICATION DATA

This application is a continuation-in-part of application Ser. No. 07/395,368, filed on Aug. 17, 1989 now abandoned, which in turn is a continuation-in-part of application Ser. No. 07/138,957, filed on Dec. 29, 1987 now abandoned, which in turn is a continuation-in-part of the prior application Ser. No. 07/106,152, filed on Oct. 8, 1987, now abandoned.

1. Field of the Invention

The invention relates to a sole for cushioning a foot, and more particularly to a sole for redistributing pressure on the weight-bearing portion of the plantar surface of the foot.

2. Background of the Invention

The prior art describes a number of shoe sole constructions having one or several compartments filled with fluid including liquid. U.S. Pat. No. 4,008,530 issued on Feb. 22, 1987 to D. Gager discloses an inflatable sole section extending from the front to the rear of the sole and fitted on the side with a flush mounted valve for inflating and deflating the sole.

U.S. Pat. No. 4,472,890 issued on Sep. 2, 1984 to S. Gilbert teaches a pair of thin-walled hollow partially liquid-filled cushions to be enclosed in the sole of a shoe. The first cushion is positioned to coincide with the plantar pads on the lower side of the wearer's metatarsal, the second—to coincide with the tuberosity of the wearer's calcaneum.

U.S. Pat. No. 4,100,686 issued on Jul. 18, 1978 to T. Sgariato et al. teaches to insert a partially filled with water bladder into the cavity inside the sole.

The aforementioned patents are not exhaustive but are illustrative of the state of art. These references suffer from the common deficiency that they do not provide the ability for the liquid, located inside the sole, to uniformly transfer the stresses, created by the foot, to the side walls of the sole, these side walls being so constructed that they are able to absorb the energy of the shock.

Additionally, these references do not provide for at least a portion of the peripheral wall of the sole to absorb by buckling the energy of the shock transferred by the liquid, while at the same time preserving the structural stability of the sole through the remainder of the peripheral wall which does not buckle.

SUMMARY OF THE INVENTION

It is an object of the present invention to provide an improved method and means for a more efficient distributing of pressures generated during the contact of a foot with ground.

It is another object of this invention to provide an improved method and means for a controlled shock absorption when the stresses, applied to the ground by the foot, many-fold increase the normal walking stresses.

More specifically, it is an object of this invention to provide a hollow chamber between the plantar surface of a foot and the ground; to provide a pressure distributing ability to said chamber via filling the chamber with continuous noncompressible liquid, so that no air is left in said chamber; to provide a pressure resistance to said chamber that no leakage of said liquid happens during its functioning as a pressure distributing means; to simultaneously provide enough flexibility to the walls and contact surfaces of said chamber said flexibility needed to transfer pressure to the liquid, which fills the chamber; to provide the ability for a normal deformation of the sole in the process of movement; to provide a sufficiently large contact area between the roof, which covers said pressure-resistant chamber, filled with said liquid, for decreasing pressures applied to the prominent parts of the sole of the foot, such as heel or metatarsal heads; to provide sufficiently thick and high walls of the chamber, said walls having an ability to buckle and stretch when the stresses applied to the chamber during jumping, for instance, many times exceed the normal stresses during walking; which will allow to decrease the incidence of foot-, ankle-, leg-, knee-, hip-, and back injury in people, whose ordinary activity includes excessive walking or running or jumping; which also allows to eliminate the need for corrective surgery in people with congenital or acquired biomechanical foot abnormality; which also allows to prevent various pressure-related problems in neuropathic feet; which also allows to reduce the shock transmitted from the heel upwards along the lower extremity of patients after total joint replacement.

The above and other objects of the present invention are realized in a specific illustrative shoe design. A shoe designed and manufactured according to this invention consists of two main parts: 1. a shoe molded unitsole to be located between the plantar aspect of the foot and the ground, 2. and the shoe upper to preserve the sole in the above described location. The sole is solid, flexible and made of pressure resilient material which is air and liquid impermeable. A hollow chamber is formed inside the solid part of the sole and should be filled up during or after formation, so that no residual air is left inside the chamber. The walls of the chamber are resilient enough in order to withstand pressures generated during the contact of the sole with the ground in the process of normal walking. However, the walls should be high enough, thin enough and flexible enough in order to stretch and buckle in order to provide a shock absorption ability when the stresses applied to chamber during jumping, for instance, many-fold exceed the normal walking stresses. The sole is connected by any known in the present art means to the upper, said upper can be of any known shape and design provided it fulfills the function of keeping the sole located between the plantar surface of the foot and the ground.

A further embodiment of the invention provides a sole having a case which is positioned between the plantar surface of the foot and the ground. The case has top and bottom members connected to each other by a peripheral wall which contributes to the structural integrity of the case. The case forms a chamber filled with liquid, sandwiched side-by-side between the top and bottom portions and within the peripheral wall of the case. The top of the chamber is made of flexible and insignificantly stretchable material. The liquid-filled chamber, which is positioned below the plantar surface of the foot and therefore beneath the heel and metatarsal bones, redistributes pressure evenly across the weight-bearing portion of the foot. The peripheral wall provides structural integrity to the case by contributing to the prevention of canting of the top portion against the bottom portion. The peripheral wall includes a first portion which is capable of elastically deforming (buckling) under the pressure of the liquid when the wearer steps on the sole. The remaining portion of the peripheral wall does not buckle while the first portion buckles. The remaining portion is thereby prevents the top of the sole from sliding relative to the bottom of the sole during the buckling of the first component. By changing the ratio between the first and the second components of the wall, a shoe manufacturer may design a sole specifically for a particular size and weight range of wearer and for particular activities, such as, walking, running, playing tennis on an asphalt court, etc.

Through its ability to redistribute pressure on the sole without sacrificing structural stability, the present invention will decrease the incidence of injury to feet, ankles, knees, legs, and hips during walking, running, or jumping. The construction of the sole may also eliminate surgery for biomechanical foot abnormalities and prevent pressure-related problems in neuropathic feet. The cushioning properties of the sole also provide for reduction of force from the contact of the heel to the ground, an obvious benefit to patients having hip and knee replacement operations.

BRIEF DESCRIPTION OF THE DRAWINGS

The foregoing and additional features and advantages of this invention will become more readily understood from the following description of illustrative embodiments thereof in conjunction with the accompanying drawings, in which.

DETAILED DESCRIPTION OF THE PREFERRED EMBODIMENTS

Figure 1:
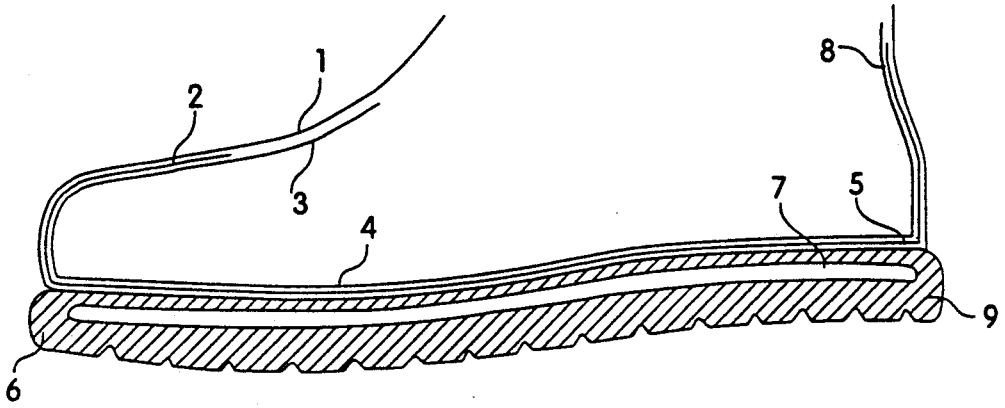
FIG. 1 is a schematic drawing of a shoe with a high upper designed according to the principles of the present invention.

In FIG. 1, there is illustrated one of the principles of the invented sole and means to attach said sole to a foot:

where 1 is the upper of the shoe that can be constructed of leather, canvas, various synthetic materials, straps etc. It can be knee high or stop above or below the ankle. It can be designed as a sandal or any other type of the shoe. In other words, as long as the principles of the invented sole construction are preserved, the designer will have complete freedom with the upper's design.

2—the optional toe box that, depending on the proposed use of the shoe or boot, can be constructed of either rigid or semi-rigid material.

3—the lining that can be made of any type of commonly used material which can be utilized for the purpose of protecting the foot surface against mechanical irritation. Lining, however, can be missing if the shoe construction fulfills the goals of the lining without the one.

4—the sock lining, that is used in the shoe construction—can be made either of material similar to lining or can be made of more absorbent cloth or leather, or special foam.

5—the insole, that is made of the material flexibility of which should be compatible with the flexibility of the sole.

6—the molded sole with fluid-filled space. The sole should be constructed so, that when the maximum expected pressure is applied to the weight bearing surface of the sole, which is its upper part, said part should never come in physical contact with the bottom surface of the chamber. The walls of the chamber should have the resistance against stretching and have the size high enough in order to prevent said contact to happen. On the other hand, the walls should have the ability to stretch and absorb the shock if the stresses created by the plantar surface of the foot during jumping manyfold exceed the normal stresses during walking. The chamber should extend all the way to the wall of the upper in the anterior, and all the way to the back part of the upper in the posterior aspect of the shoe. The front wall of the chamber should, therefore, extend beyond the toe box and behind the back part of the upper. The size of said extension should be equal to at least one full thickness of the chamber wall.

7—the liquid that fills up the chamber. Said liquid can be of any matter that carries physical characteristics that allow it to be called as such. The liquid should preserve its state of fluidity within temperature range from −40 to 120 degrees F, and under pressure from 0 to 2000 lbs.

8—optional counter which can be rigid or soft and located between the lining and the upper.

Figure 2:
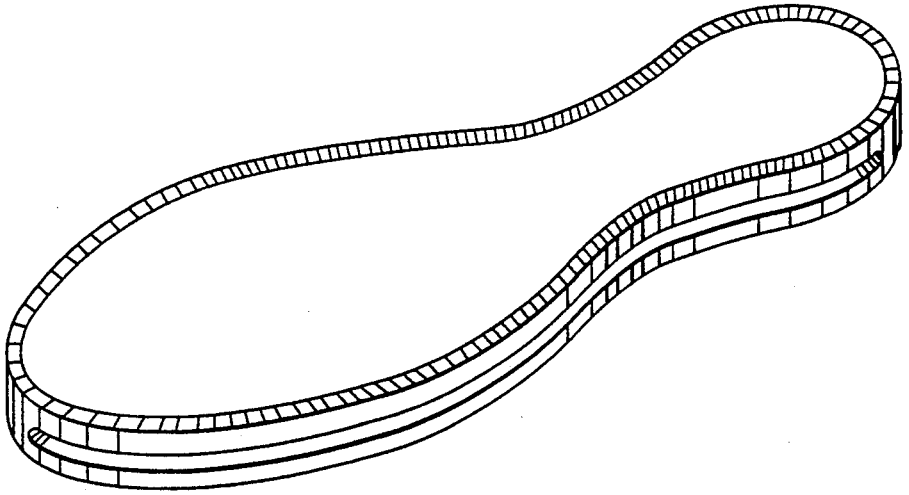
FIG. 2 is a more detailed illustration of the design of the shoe sole, shown in FIG. 1.

Referring now to FIG. 2, there is shown another illustration of the invention demonstrating a different perspective of the shoe sole. Where 1—is a rim, 2—a chamber filled with the liquid, 3—a posterior wall of the chamber. In order to see said portion of posterior wall the side wall is removed. As it is seen, the sole of the shoe should be longer and wider than the upper by the thickness of the chamber wall.

Figure 3:
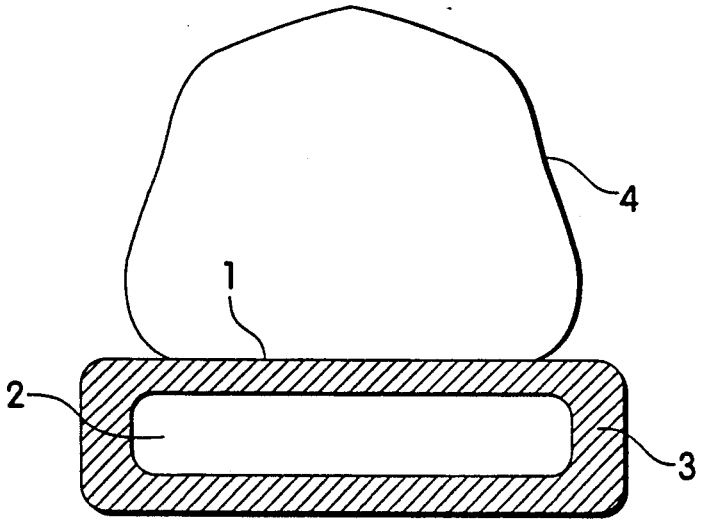
FIG. 3 shows the cross-section view of the shoe of FIG. 1.

In FIG. 3, a cross-section of the shoe of FIG. 1 is shown. Where 1—is an insole, 2—a liquid filled chamber, 3—a chamber wall, 4—an upper. The width of the chamber 2 should be predominantly equal to the width of the insole. The height of the chamber walls can vary depending on the volume of the chamber that the designer wishes to obtain. The walls should be high enough to prevent against physical contact of the ceiling and bottom part of the chamber at extreme stresses imposed to said chamber. The walls should be resistant enough to prevent buckling during the process of normal walking. However some buckling should happen in order to absorb shock when the stresses applied to the chamber many times exceed the normal stresses during walking.

Figure 4:
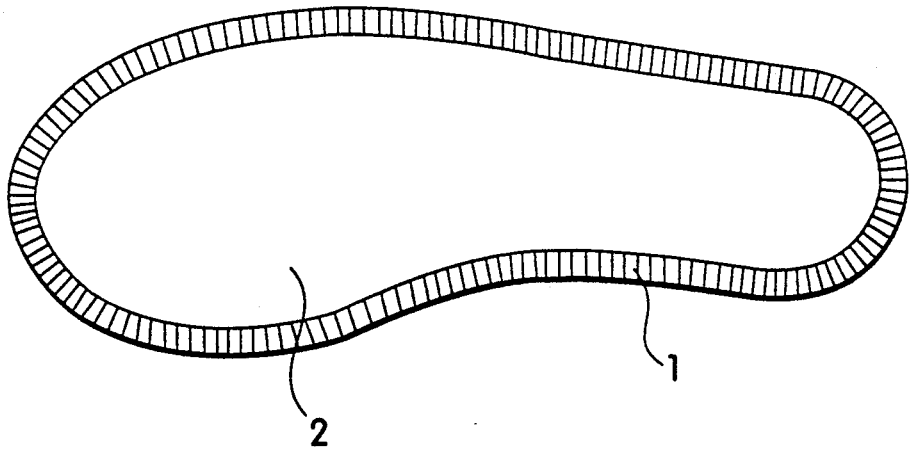
FIG. 4 shows the top view of the shoe sole of FIG. 2.

In FIG. 4, is shown an overview of the sole from the top, where 1—is a rim of the sole, 2—a chamber roof. In this figure an optional rim around the chamber is being indicated. The size of the rim is independent from the size of the roof of the chamber which is in immediate contact with the plantar surface of the foot.

A shoe sole with a hollow chamber according to this invention can be manufactured by a number of methods one of which is described below for illustration. The hollow sole can be made of two halves manufactured separately with the help of injection mold. The material which is used to form the half of the sole should be air and liquid impermeable. A semicircular opening may be formed in a wall of each half. When two halves are put together, two semi-circles will form a round opening with a diameter big enough to accept a tip of the device employed to fill the chamber with the liquid and to remove air out of the chamber at the same time. Instead of two semi-circles one hole can be formed in one half of the sole for the purpose of filling the chamber with the liquid. Said sole half may have a special second hole in order to allow the air to go out when the liquid fills up the chamber. The holes in the chamber should be sealed after the chamber is filled up with liquid. A chamber may have no hole at all for the liquid injection. In this case liquid is supplied in a flexible plastic container, the volume of this container exactly equal to the volume of the empty space of the chamber. Then, this container is being encapsulated in the sole during the process of gluing or welding two halves of the sole together. The welt of the sole can be then reinforced with a stitch. The upper of the shoe can be attached to the top half of the sole before or after the sole formation.

Figure 5A:
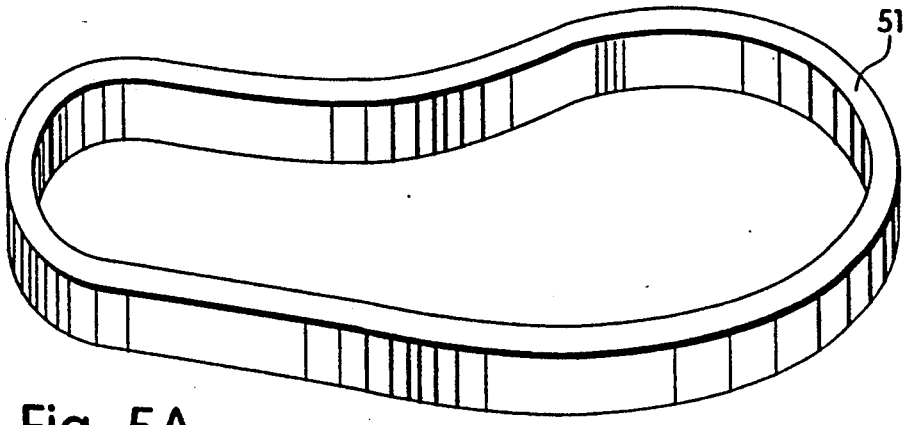
FIG. 5 shows a shoe sole construction where the chamber inside the sole is filled up with a multitude of individual containers.
Figure 5B:
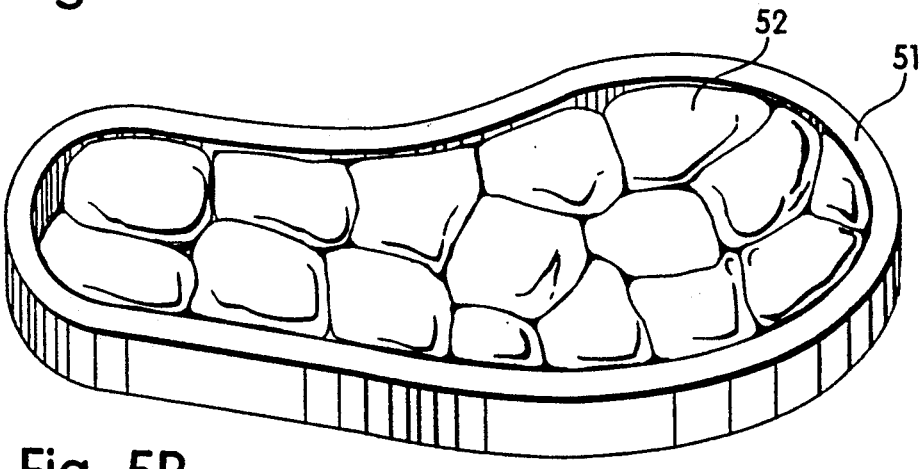
Figure 5C:
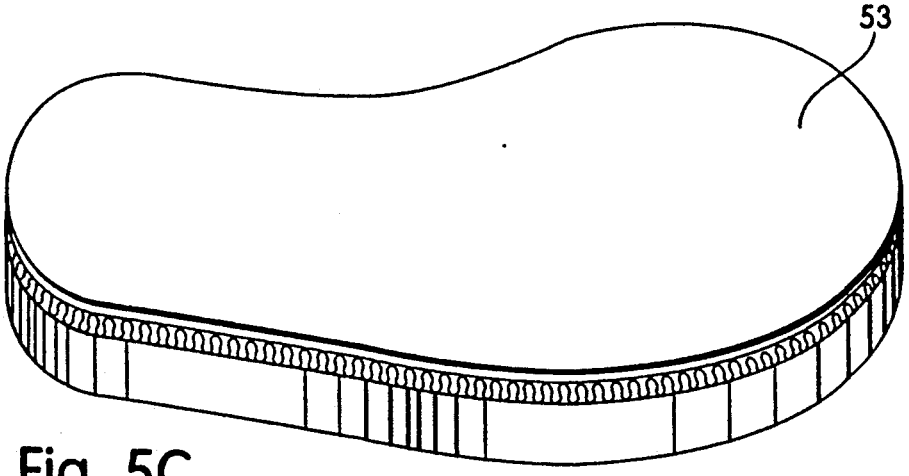

In another embodiment of this invention the sole with a hollow chamber is manufactured in the following three steps. Step 1—the sole 51 is made open from the top only (see FIG. 5*a*). Step 2—said open sole is filled up with a multitude of individual containers 52 (see FIG. 5*b*), said containers being made of a material which becomes easily flexible and stretchable at pressure levels normally applied to this material, each container being filled up with liquid without any air left in the container. said material may be plastic (like natural rubber, or polyethylene, or polypropylene, etc.), or any other material demonstrating similar properties at the same levels of pressure which is applied to these materials. Step 3—after the containers were packed in said open sole so that no air is left in between the boundaries of adjacent containers, the sole is covered by the roof 53 made of flexible and insignificantly stretchable material which is attached to the walls of the sole (see FIG. 5*c*) by any known means (gluing, welding, etc.). Said containers with liquid, filling up the sole chamber, hydrostatically distribute pressure essentially in the same manner as the continuous liquid, which is not separated by the walls of the containers. The purpose of using a number of containers filling the chamber instead of a just one container is to provide the sole the ability to preserve a substantially high degree of performance in case when one of the containers is pierced and the liquid leaks out. Another reason for using small containers is that it is convenient to fill up a variety of sizes of the sole with the liquid by just changing the number of containers.

Figure 6A:
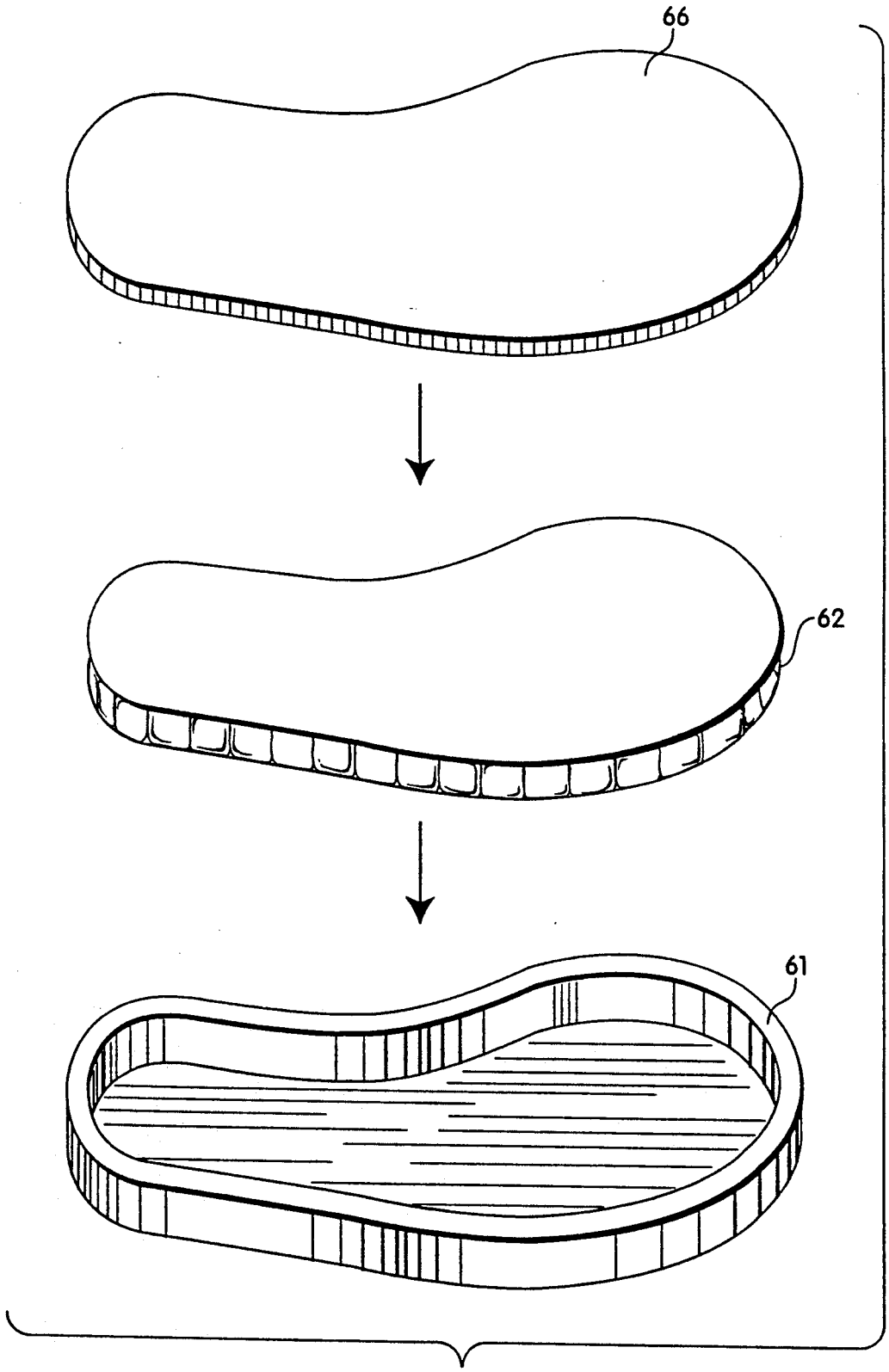
FIG. 6 shows a sheet insert material filling the hollow chamber inside sole.
Figure 6B:
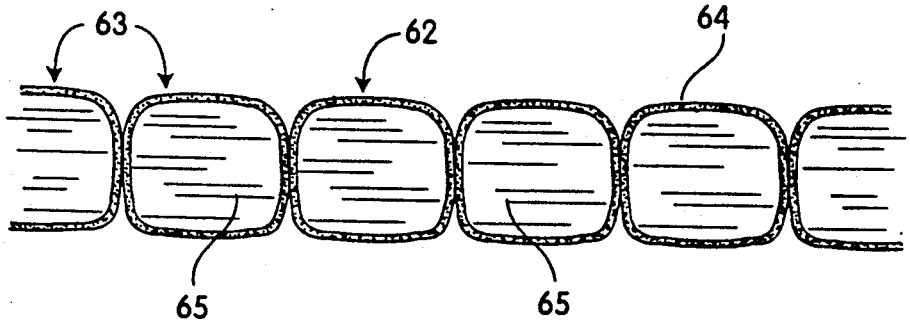

In still another embodiment of this invention, the sole with a hollow chamber is manufactured in three steps similar to those described above. The first step is exactly the same as the described above Step 1. Step 2—an open sole 61 is filled up with the insert 62 which is cut off from a prefabricated sheet insert material (see FIG. 6*a*). The insert material is made of separate containers 63 each of them being made of a material 64, which becomes easily flexible and stretchable at pressure levels habitually applied to this material. Each container is filled up with the liquid 65 with no air left in the container (see FIG. 6b). Said material 64 may be plastic (like natural rubber, or polyethylene, or polypropylene, etc.) or any other material demonstrating similar properties at the same levels of pressure which is applied to these materials. All containers are connected to each other by any known means (glued, welded, etc.) forming a one-layer sheet 62 so that no air is left in between the boundaries of two adjacent containers. The third step if exactly the same as the described above Step 3. of covering the sole with the roof 66.

Figure 6C:
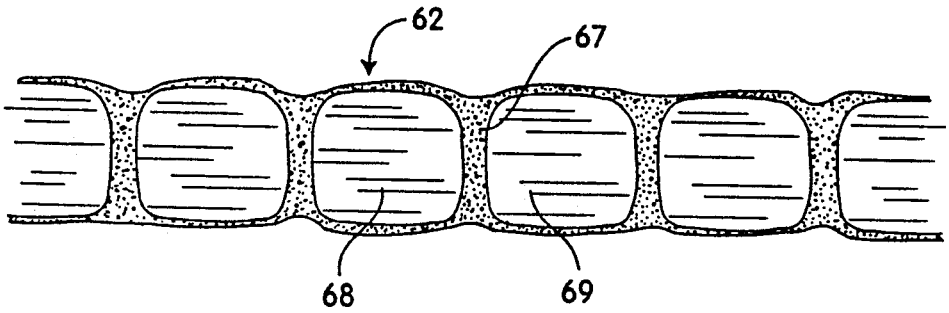

In another version of the insert material, said material has a preformed cellular (for example honeycomb) structure distinguished by the feature that a wall 67 of a cell belongs to two adjacent cells 68 and 69. Each cell of said structure is filled up with liquid and sealed (see FIG. 6c). The walls of cells are made of a material which is flexible enough at the applied levels of pressure to easily transfer pressures from the liquid of one cell to the liquid in another cell.

Figure 6D:
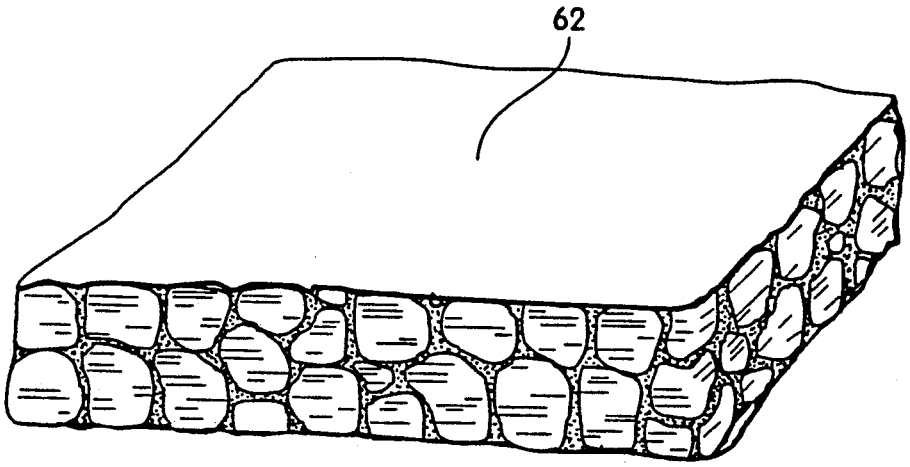

In still another version of the insert material, said material has a multi-layer structure (see FIG. 6d) allowing to use rather small cells in the material, reducing the degree of loss of functional ability if one or several cells were punctured and lost liquid.

Figure 7A:
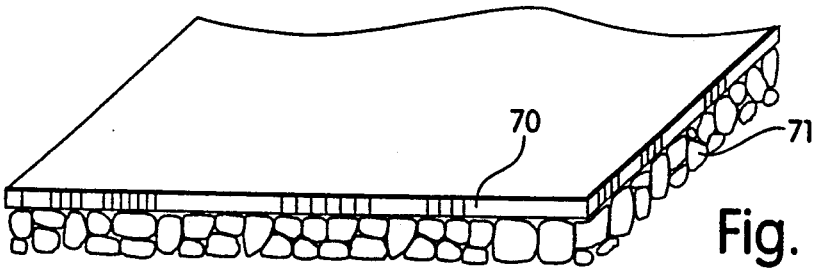
FIG. 7 shows another version of the insert material shown in FIG. 6.
Figure 7B:
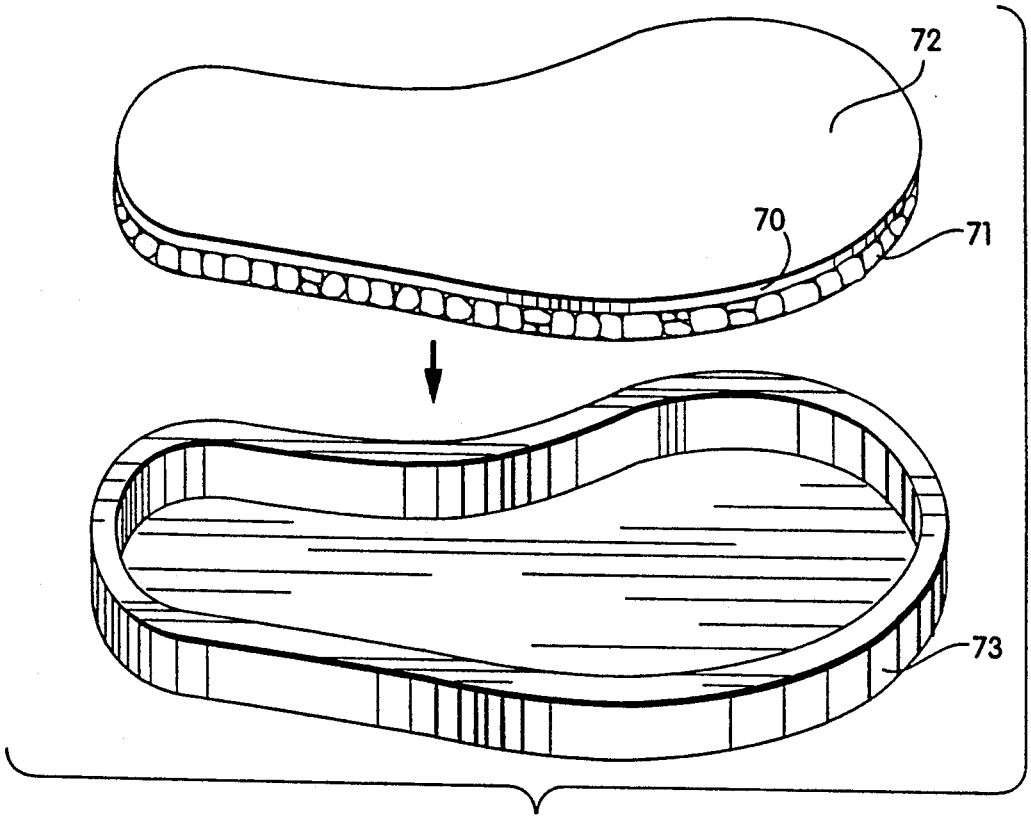
Figure 7C:
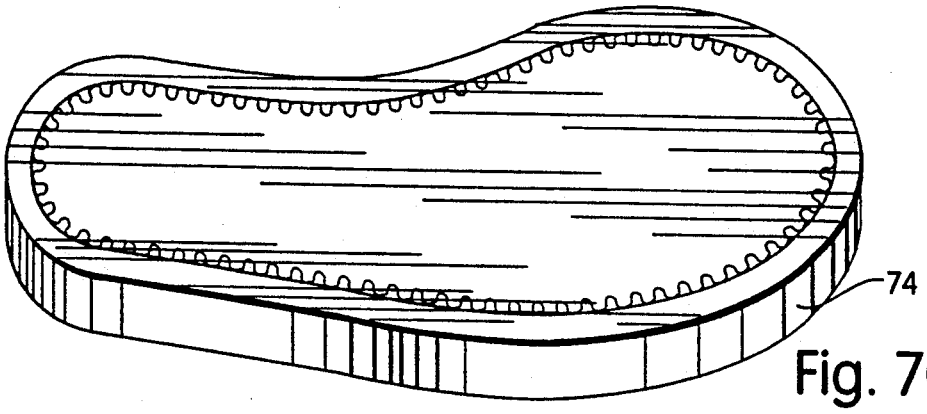

In another version of the insert material the layer 70 which is used as a roof of the sole, is attached by any known means (gluing, welding, etc.) to one side of the insert material 71 (see FIG. 7a). The insert 72 is cut off from this two-layer material and said insert is fitted into the open sole 73 (see FIG. 7b), the roof of the insert is then attached to the walls of said sole by any known means (gluing, welding, etc.) creating a sealed sole 74 (see FIG. 7c).

Figure 8A:
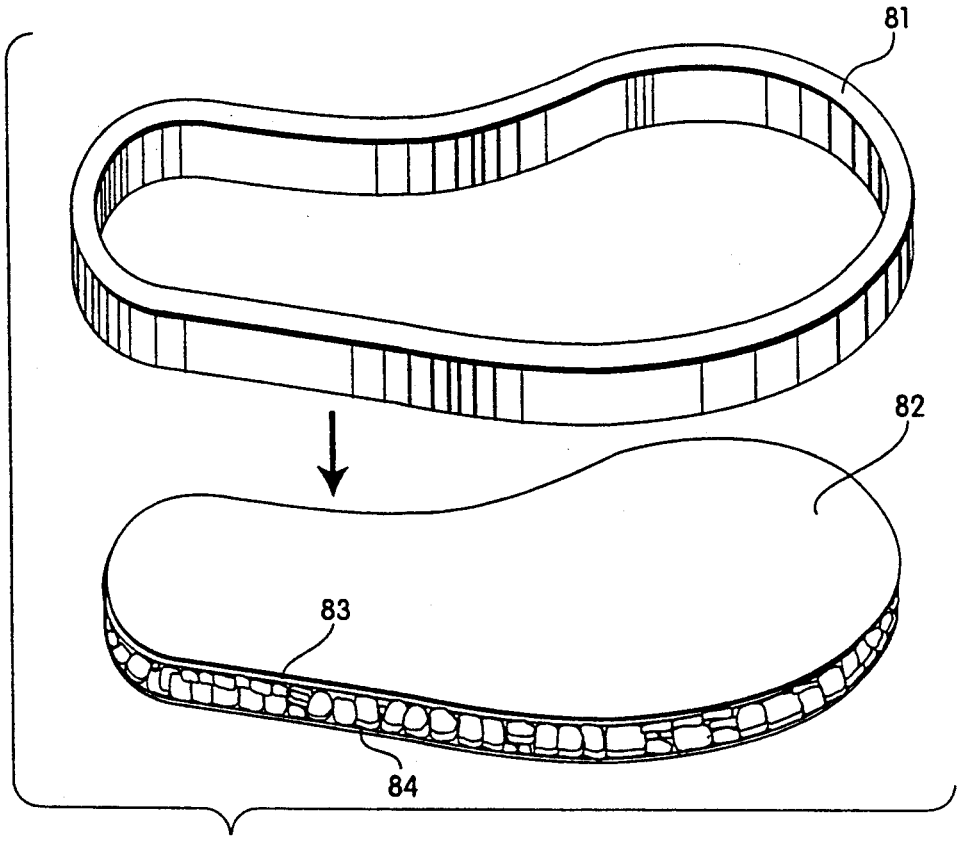
FIG. 8 shows still another illustration of the principle demonstrated in FIG. 6.
Figure 8B:
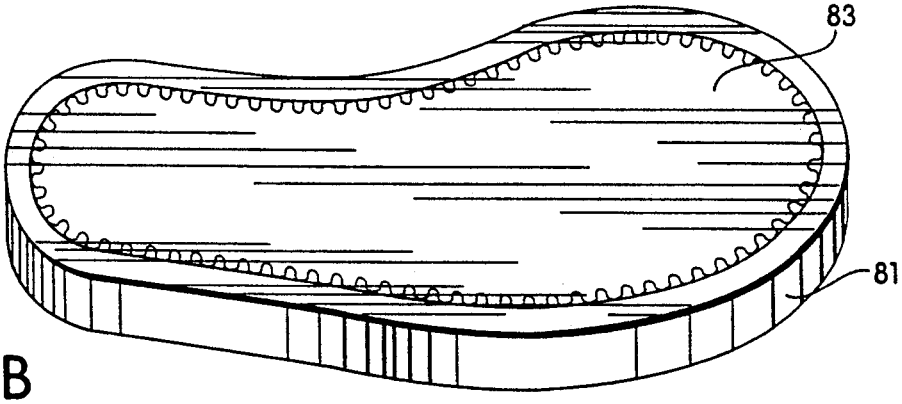
Figure 8C:
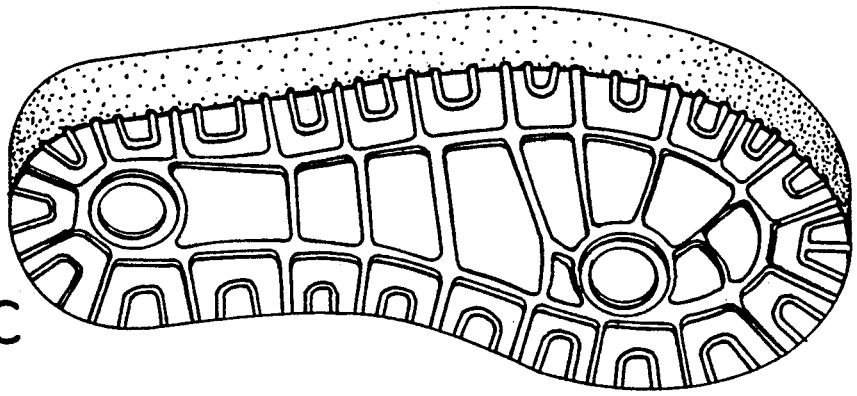

In still another embodiment of the invention the sole with a chamber, filled up with a liquid containing material, is manufactured in the following three steps. Step 1—a sole frame 81 is made without roof and without bottom, said frame essentially consisting of the walls of the sole (see FIG. 8a). Step 2—an insert 82, which is cut from the insert material, is fitted into said frame, said insert having a layer 83 of roof material attached to the top of the insert material by any known means, and the layer 84 of the bottom material, which is the outsole, attached to the bottom part of the insert. The insert material itself is a one—or multi-layer material made of separate containers filled up with liquid, or a material with cellular (e.g. honeycomb) structure, each cell of the structure filled up with liquid. Step 3—the roof 83 of the insert is glued or welded to the top portion of the frame 81 (see FIG. 8b) and the bottom 84 of the insert, which is the outsole, is glued or welded to the bottom portion of the frame with no air left inside the formed chamber (see FIG. 8c).

Figure 9A:
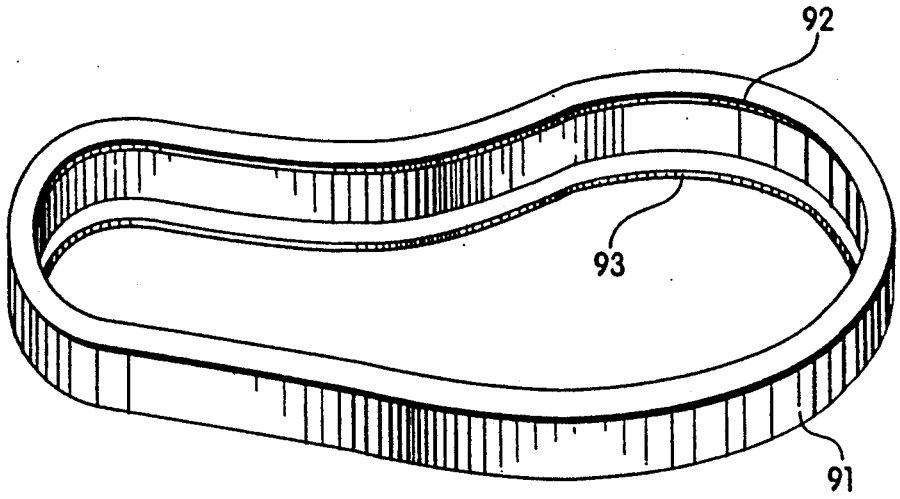
FIG. 9 shows a sole formed from a cylinder open from both sides.
Figure 9B:
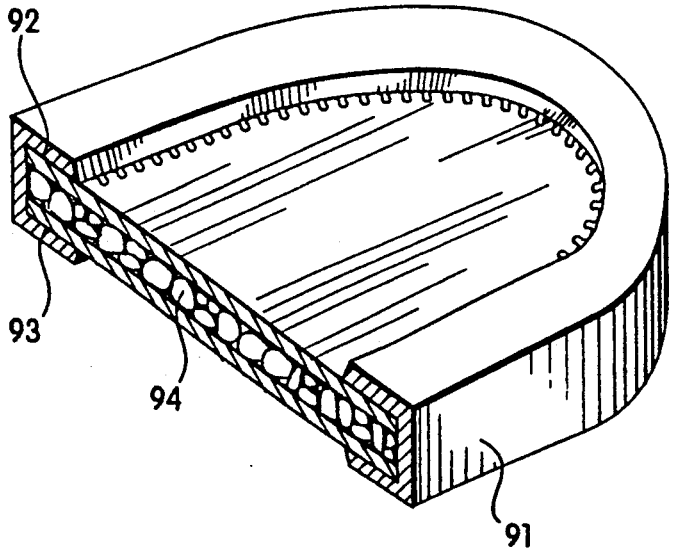

In another embodiment of this invention the sole is molded to form a cylinder 91 open from both sides, each side having a continuous inbound shoulder 92 and 93 (see FIG. 9a). The purpose of the shoulders is to provide a better binding contact between the insert 94 and the sole frame after the precut insert is snapped inside the sole frame. The frame shoulders are then attached by any known means (glued, welded, etc.) to the roof and to the bottom of the insert, which is the outsole (see FIG. 9b).

In still another embodiment of this invention the sole 101 has two hollow chambers, 102 and 103. The hollow chamber 102 is formed by the sole wall 104, said wall being made resilient, to the applied pressures, and by an internal wall 105 which runs continuously inside the sole in parallel with the external wall 104, along the whole wall 104 or a part of it. Said internal wall 105 withstands without substantial deformation ordinary pressures applied to this wall during walking process. However, wall 105 deforms when the pressures exceed levels of walking pressures. The chamber 102 is created by the walls 104 and 105 has the form of a channel and said channel is filled with air. The chamber 102 can also be created by a tube attached to wall 104. The inner chamber 103 is formed by the roof 106 of said chamber, by the outsole 107, and the internal wall 105. Said chamber 103 is filled up by liquid or by liquid substituting material. The purpose of this construction is to provide a smoother and substantially controlled absorption and dissipation of kinetic energy when stresses applied to the roof and ground portions of the sole many-fold exceed the ordinary walking stresses. These excessive stresses are generated during running and/or jumping in the phases of toe-off and landing. The applied excessive stresses are then uniformly transformed through the liquid to the whole inner surface of the sole, however the stresses, applied to the wall 105 cause the wall to deform and absorb a portion of the generated kinetic energy, which becomes the potential energy to be later comfortably returned to the foot. The returned kinetic energy generates pressures distributed along the whole plantar surface of the foot creating a feeling of a particular lightness and comfort during the process of movement. The amount of kinetic energy absorbed via deformation of the wall 105 and the degree of said energy dissipation into heat depends on the thickness of the wall material and its resilience. said deformation is limited by the essentially nonstretchable external wall 104 of the sole, preventing the sole from collapsing. Said collapsing would happen if substantial portion of the liquid, filling chamber 103, is pressed into the buckled area at excessively high pressure levels, generated during e.g. jumping, and this deformation is not stopped by a nonstretchable wall 104, therefore causing the ceiling of the roof 106 of the chamber 103 to get into immediate contact with the bottom 107 of said chamber, which essentially constitutes the collapse of the sole.

Figure 10A:
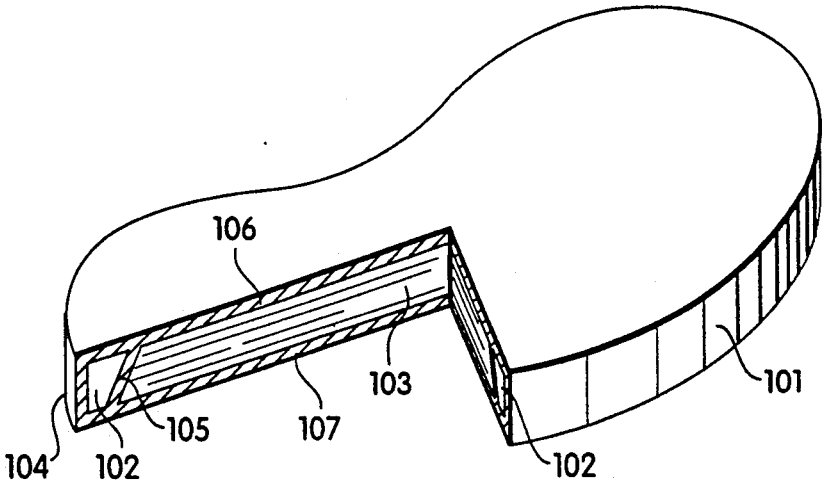
FIG. 10 illustrates the principle of magnifying and reducing the force created during the contact of a shoe sole with ground.
Figure 10B:
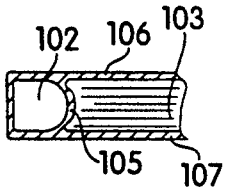
Figure 10C:
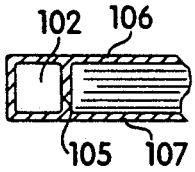
Figure 10D:
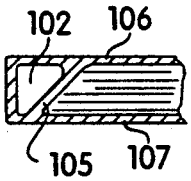
Figure 10E:
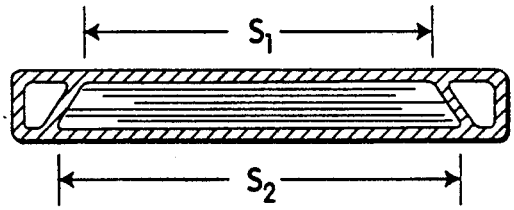

The channel 102, which is filled with air, may have a round (see FIG. 10b), rectangular (see FIG. 10c) or any other cross-sectional configuration. However, said channel should predominately have a triangular (see FIG. 10d) or trapezoidal cross-section configuration with the top of the triangle, or the shorter base of the trapezoid being located at the bottom of the chamber (see FIG. 10d and 10e). The roof 106 of the chamber in FIG. 10e, which is in direct contact with the plantar surface of the foot has a surf ace area $S_1$, essentially smaller than the surface area S2 of the outsole, which transfers the pressure from the liquid to the ground. The reactive force $F_R$ created by the ground is applied to the surface $S_2$ which creates pressure $F_R/S_2$ transferred evenly inside the sole by the liquid. Said pressure, multiplied by the smaller surface $S_1$, will effectively create a force, acting at the foot, which is only a $S_1/S_2$ portion of the initial reactive force $F_R$. In other words, the larger the surface of the outsole, which contacts the liquid inside the chamber, in comparison with the surface of the insole, which contacts the plantar surface of the foot, the lesser stress is transferred to the foot. A sole with $S_1 < S_2$ provides a force dividing effect—the force created via contact of the outsole with the ground becomes smaller when it reaches the foot.

Figure 10F:
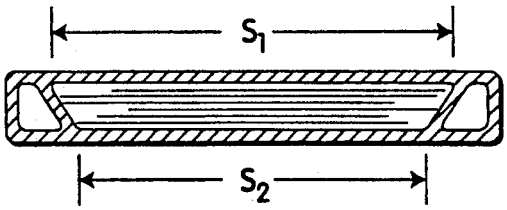

And vice versa, if $S_1 > S_2$, as it is shown in FIG. 10*f*, the sole provides a force magnifying effect. The force $F_R$ created during the contact of the outsole 107 with the ground, generates pressure $F_R/S_2$ which is transferred by the liquid to the ceiling of camera 103, which then is multiplied by the larger surface $S_1$ and creates a force which iS $S_1/S_2$ tines bigger than the force $F_R$.

The filled with air channels in the described above embodiment of this invention constitutes a cavity filled with air, which is located along the wall inside the sole. According to this invention this cavity, which is able to deform at pressures exceeding the normal levels, may be located anywhere inside the chamber filled with liquid. Moreover, there may be not a single one but several of these cavities created inside the chamber.

Figure 11:
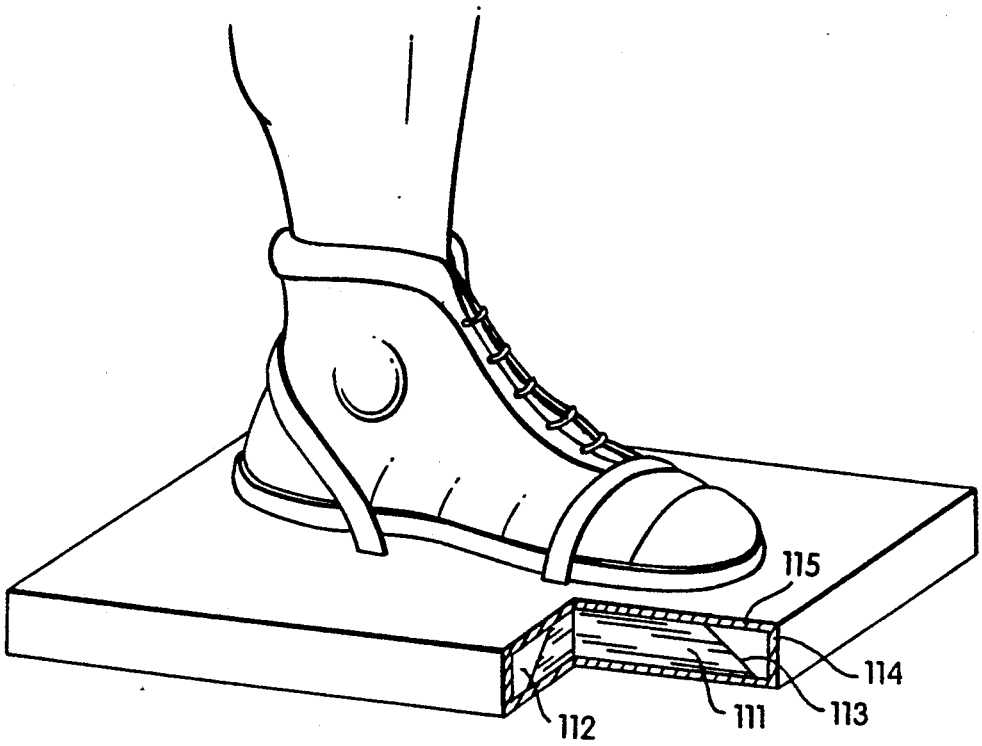
FIG. 11 illustrates detachable soles for a parachute jumper.
Figure 12:
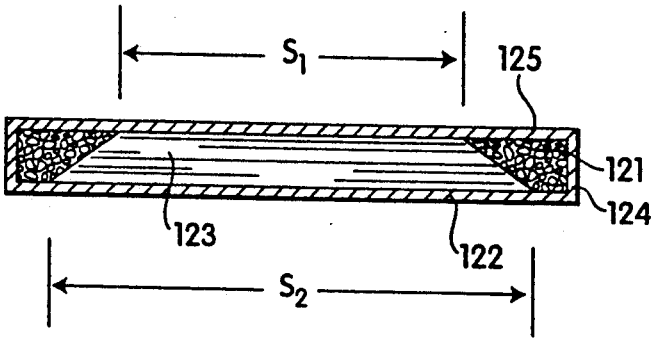
FIG. 12 illustrates using a sponge-like material instead of air-filled channels to absorb and dissipate kinetic energy.

The described above force dividing phenomenon is used in another embodiment of this invention, which specifies a force-dividing and shock absorbing detachable soles for parachute jumpers (see FIG. 11*a*). The liquid-filled camera 111 in this sole is rather large. Proportionally large is the internal channel 112 filled with air, said channel having resilient but stretchable at high pressures internal wall 113 and nonstretchable external walls 114 and 115. The ratio of the outsole surface $S_2$, which gets in contact with the ground, to the plantar surf ace $S_1$ of the foot determines the portion of the impact force which is transferred by the liquid to the foot through the plantar surface of the foot. The purpose of the internal channel 112, filled with air with or without additional pressure, is to give the wall 113 a room to stretch and buckle at the moment of landing, when the pressure inside the chamber 111 exceeds resilience of the wall 113 and the air pressure inside the channel 112. Camera 111 should have enough liquid in order to prevent the ceiling and the bottom of the camera to meet when the channel 112 is deformed. The landing soles should have the ability to easily disengage from the shoe of the sky-diver in case the torque or excessive flexion or extension of the ankle is created in the process of landing. Landing detachable soles made according to this invention may allow the sky-diver to reach the highest levels of acceleration during the free fall portion of the descend, leaving a very short time to fly with the parachute open, in this way increasing the precision of landing.

In still another embodiment of this invention a sponge-like resilient but compressible material 121, which, however, does not absorb liquid, is used instead of air filled channels in order to absorb and, to a certain degree, dissipate the kinetic energy generated during the impact of the outsole 122 with the ground. The chamber 123 is filled up with liquid or liquid substituting material. The side walls 124 and 125 of the sole are made of essentially non-stretchable material which can resist without significant deformation pressures which are transferred to said wall by the layer of sponge-like material 121. The cross section of said sponge-like material should have a configuration predominately becoming thinner in the area close to the bottom 122 of the sole chamber 123 in order to increase the surface area $S_2$ of the outsole, which transfers stress to the liquid. If said area $S_2$ is larger than the surf ace area $S_1$ of the camera ceiling, which is in direct contact with the plantar surface of the foot, then the sole provides the stress-dividing ability described above.

Figure 13:
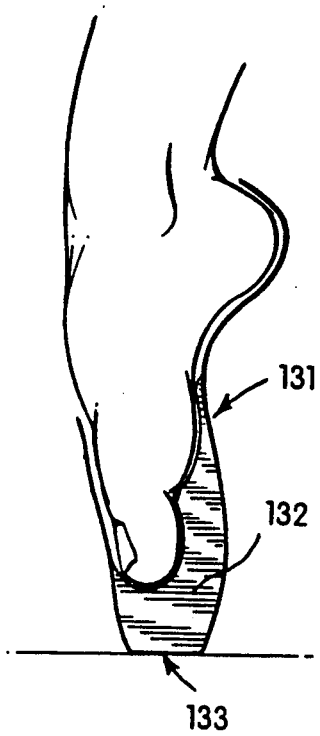
FIG. 13 illustrates the force magnifying effect in the ballet shoes according to this invention.

The principle of magnifying forces is used in another embodiment of this invention according to which the ballet shoes are made with a sole 131 having a camera 132 filled with liquid (see FIG. 13). Said camera extends to a tip-toe area which gets into contact with the ground creating a reactive force, which generates in the liquid in the vicinity of tip-toe area 133 a rather high pressure. Said pressure is then transferred by the liquid to the plantar aspect of the foot, creating a force which exceeds the force at the tip-toe area as much as the plantar surface of the foot exceeds the surface of the tip-toe area. Force magnifying effect provides a feeling of reduced weight.

The force magnifying phenomenon provided by a sole with a cross-section shown in FIG. 10*f*, can be particularly beneficial for hurdlers, who need to make jumps during running, and, of course, for jumpers also.

In another embodiment of this invention the sole, which is made according to this invention, is attached to an upper which is essentially the upper of a galosh (overshoe) in which another shoe can be inserted. Traditionally overshoes are worn on rainy days to protect leather shoes. Galoshes with the sole made according to this invention can be used as an aid at any day for walking a long distance, or running.

Figure 14:
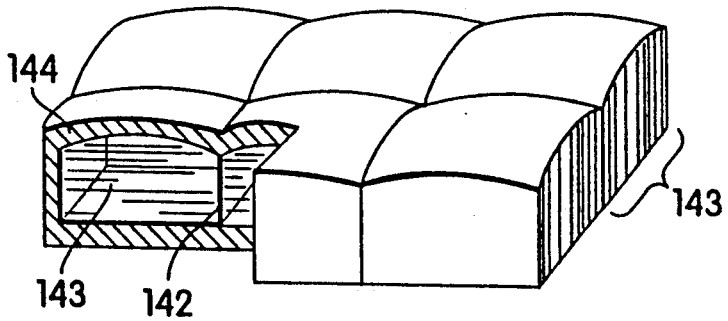
FIG. 14 to FIG. 17 illustrate different embodiments of a multiple sole material.

The principles of the sole construction of this invention, according to which the sole has a hollow chamber filled with a liquid, or with its substitute (like a material containing liquid in its cells), said sole having the ability to hydrostatically distribute to the whole plantar surface of the foot the stresses applied to one part of the plantar surface of the foot, said sole also having a wall which is capable to partially absorb kinetic energy created during running or/and jumping, said kinetic energy many-fold exceeding kinetic energy which is created during walking. The absorbed energy is transformed into potential energy of a deformed wall, said potential energy is then comfortably returned to the foot. Another portion of kinetic energy is dissipated into heat by the same deformed wall. One or all of said principles are extended in this invention to a material which represents a multiple sole 140 (see FIG. 14). This material consists of separate sole elements 141 in the form of triangular, or square or rectangular, or hexagonal, etc. chambers, all chambers connected to each other so that a wall 142 of one sole also belongs to the adjacent soles, each sole element having the dimension of the contact area of predominately half of foot, but may be also substantially less or more than half of foot. Each sole element has a wall 142, said wall being flexible but essentially non-stretchable. Each chamber is filled up with liquid 143, or liquid substituting material. The roof 144 is also flexible but essentially non-stretchable. The purpose of this embodiment of a multiple sole is to predominately distribute the created pressure by one part of the foot to the whole plantar surface.

The described multiple sole material, each sole filled up with liquid or liquid substituting material, can be used as a floor or a mat for aerobic dancing or any other athletic activities involving intensive stresses generated by foot. Said material can also be used for protecting athletes from injuries in the process of landing in athletic halls or fields, or in circus. Said material can also be effective as a protective means against injuries caused by excessive stresses applied to other, than feet, parts of human body, for instance, during collisions of hockey-players with boards of a skating rink. In order to protect players the boards should be covered with said material.

Said multiple sole material can be effectively used inside a helmet, elbows, shoulders or knee protectors. Said material can also be used for protecting astronauts during launching. Said material can also be used as vibration absorbing means located under the machines and apparatuses creating vibrating stresses. Said material can also be used as a padding for seats of chairs, including computer chairs with knee support, benches, toilet seats, etc.

Figure 15:
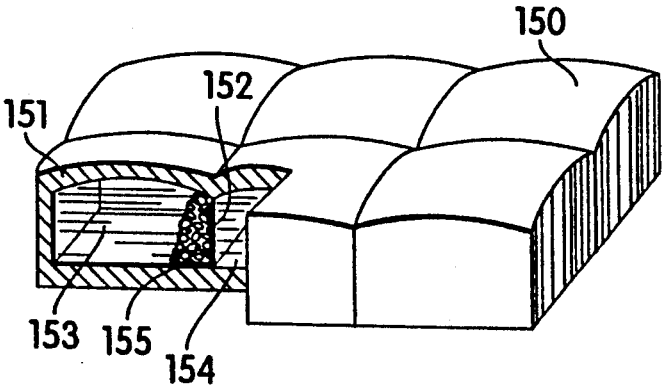

In another embodiment of a multiple sole 150, a wall 152, belonging to two of each adjacent chambers 153 or 154, is covered from the side of one chamber, say chamber 153, with an impermeable to liquid, compressible material 155, said material (like rubber sponge, etc.) being capable to deform by the liquid 156 at pressures exceeding the critical level, said deformation allowing to dissipate into heat a portion of kinetic energy created during the impact of an object, say foot, with the roof 151 of said multiple sole 150, and also to absorb another portion of said kinetic energy transferring it into potential energy of the compressed material, said potential energy then comfortably returning as a kinetic energy back to that object, which initially created the impact (see FIG. 15). The configuration of the material covering the wall 152 should be predominately narrowing towards the ceiling of the chamber so that at the ceiling area it is only the wall 152 which is in contact with the ceiling. The purpose of this configuration is to provide a larger surface of the roof of the multiple sole for a direct transfer of the impact force to the liquid of the chamber, or chambers contacted by the object.

Figure 16A:
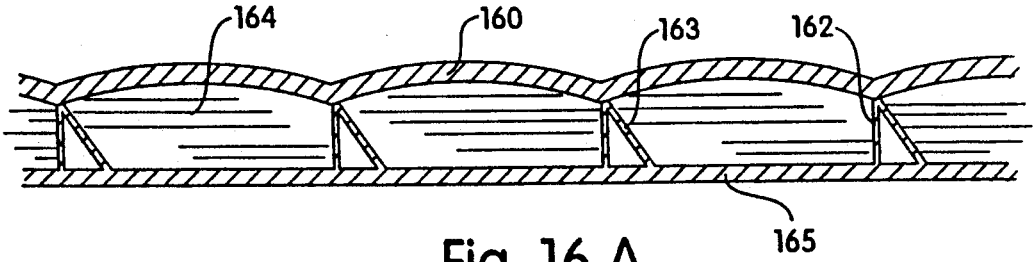
Figure 16B:
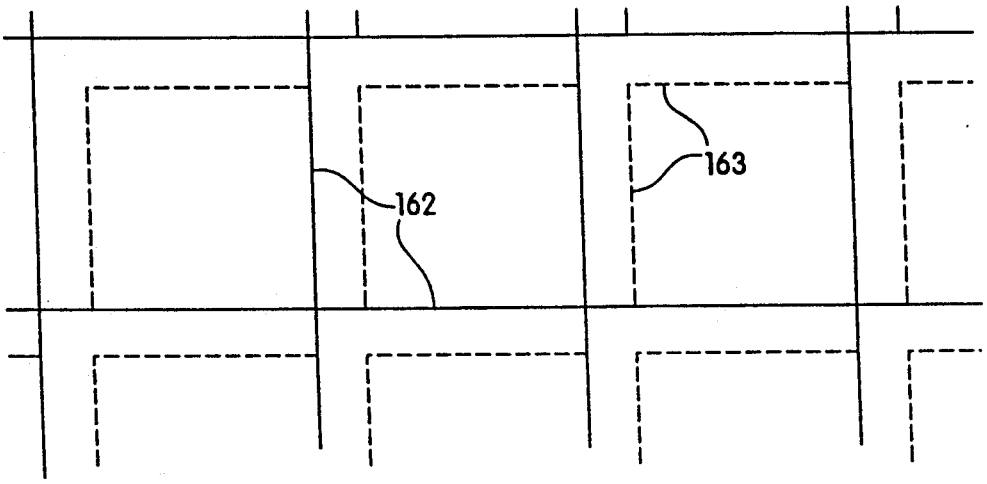
Figure 16C:
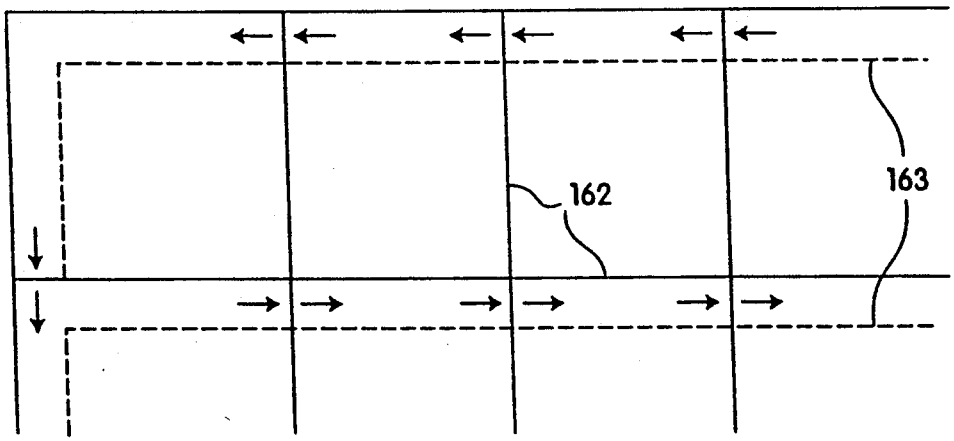

In still another embodiment of a multiple sole 160 every nonstretchable wall 162 of a chamber is covered from one side by a wall 163 which is made of flexible and stretchable material which would deform when the pressure transferred to the wall by the liquid 164, filling up the chamber, exceeds the resiliency of the material of the wall 163 and the air pressure inside the channel, formed by essentially nonstretchable wall 162, by essentially stretchable channel wall 163, and by the bottom 165 of the multiple sole (see FIG. 16*a*). A map of location of the bottoms of walls 163 (shown in broken lines) relatively to the location of the bottoms of walls 162 (shown in solid lines) of a multiple sole is demonstrated in FIG. 16*b*. The channels filled with air may be all connected to each other creating a channel network (see FIG. 16*c*). The air pressure inside said channel network can be controlled by an external air compressor connected to this network. The level of air pressure changes the ratio of kinetic energy dissipated into heat to that one which is absorbed by channel walls and then returned back. The level of air pressure also controls the critical pressure at which the walls of the channels start to deform. This feature is highly desirable for athletic mats.

Figure 17:
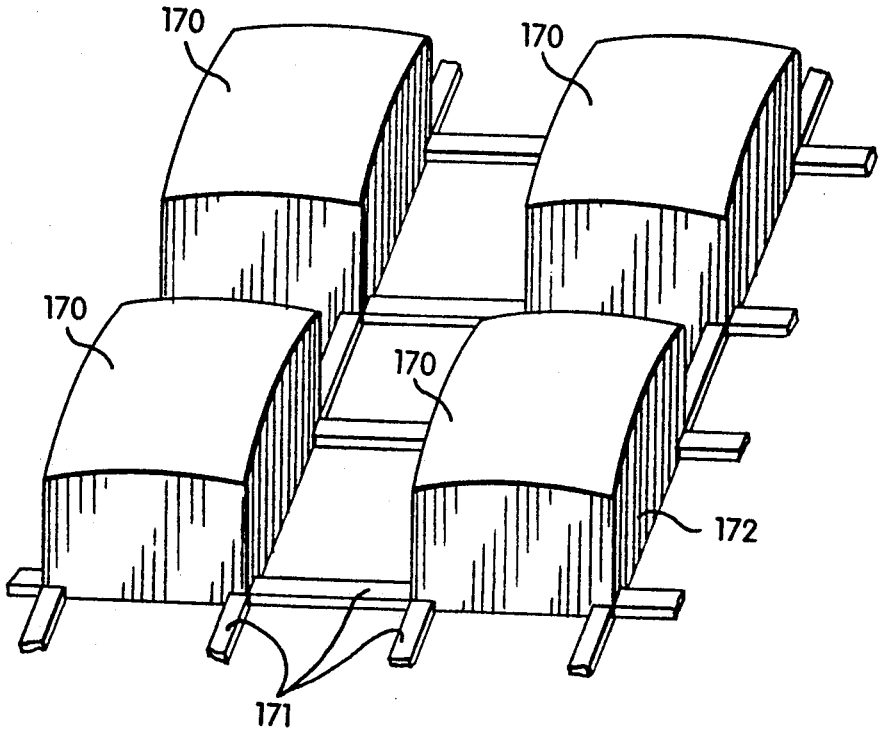

Another embodiment of a multiple sole consists of a multitude of liquid filled soles 170, each sole being made according to one of the embodiments of this invention, said soles are separated from each other by air space or any other substance, and connected to each other predominately at the bottom of the soles by a continuous or mesh-like base 171 made of essentially resilient and nonstretchable material (see FIG. 17). The wall 172 and roof of each chamber is also made of essentially nonstretchable and resilient material. Though the individual soles 170, shown in FIG. 17, have a rectangular shape, they however may have any other shape. A multiple sole of this construction can be effective for customized seats for patients with cerebral palsy, myelo dysplasia and other spastic and paralytic conditions. said sole can also be convenient for any other type of seating. This multiple sole can be also supplied by means of heating the individual soles, e.g. providing an electrical heating element network located at the bottom part of the soles.

Any liquid can be used to fill the hollow chamber of the sole, or the cells of the insert material, which substitutes continuous liquid. A liquid should have density equal, lower or higher than density of water. The liquid with lower than water density can be chosen from spirits (alcohols), like monoatom alcohols (methyl-, ethyl-, etc. alcohols), or oils like linseed oil, cotton seed oil, etc.

A liquid having density higher than that of water can be chosen from many-atom alcohols (like glycerine), glycols (like ethyleneglycol, etc.). Water in combination with ethyleneglycol or alcohols can also be used in the proportion to secure antifreezing properties of the liquid in the temperature range normal for the user of a shoe with the sole described in this invention.

We will consider the following conceptual example in order to arrive at some general principles of designing a sole according to this invention.

Let us assume that the length of a sole is equal to 12 inches. Let us consider in the first approximation the sole as a rectangular box with the average width, which is equal to one third of the sole length:

$$\tfrac{1}{3} * 12\ in = 4\ in.$$

The surface area of the bottom part of said sole will then be equal to $$12\ in * 4\ in = 48\ in^2.$$

Let us assume that the weight of a person having a 12-inch-size foot is in the range from 150 to 300 lbs.

While standing on one foot this person creates an applied to ground force, which we will call a "static force". This force will be in the same range as the person's weight (from 150 to 300 lbs). The ground in response creates a force of the same magnitude acting in the opposite direction and applied to the sole. This reactive force is distributed along and across the surface area of the bottom portion of sole, which contacts ground, creating in each square inch a pressure in the range from 150 lb/48 in$^2$ to 300 lbs/48 in$^2$. By substituting 1 lb/in$^2$ by 1 psi we arrive at a pressure range from 3 to 6 psi.

Dynamic stresses, which are generated in the process of walking, about twice exceed static stresses generated by a standing person. This means that the pressure created in the bottom part of the sole chamber may range during walking from 6 psi to 12 psi depending on the person's weight. Each square inch of the chamber ceiling and of the walls will be subjected to exactly the same level of pressures because said pressures are transferred by a incompressible liquid.

The dynamic stresses, generated in the process of jumping, about 4 times exceed the static stresses. Pressures created in a liquid may therefore reach 12 psi for a lighter person and 24 psi for a heavier person.

Figure 18A:
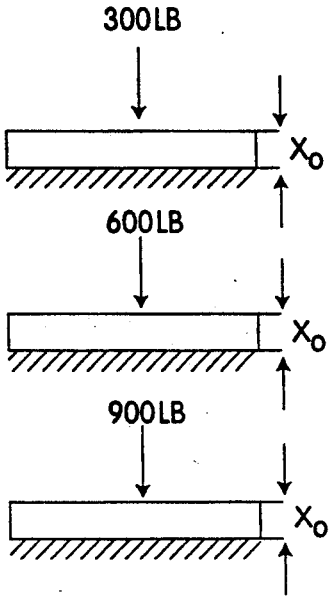
FIG. 18A is a partial cross-sectional view of a sole positioned against the ground, the sole having a liquid-filled case surrounded by a non-buckling peripheral wall of height $X_o$, which remains constant as different stresses are applied to the case.

If the peripheral wall of the chamber is non-stretchable and the plantar surface of foot covers the whole surface of the chamber ceiling and said ceiling is made of substantially non-stretchable (but flexible) material, then the distance between the ceiling and bottom of the sole does not change at any pressure generated in a liquid (see FIG. 18*a*).

Figure 18B:
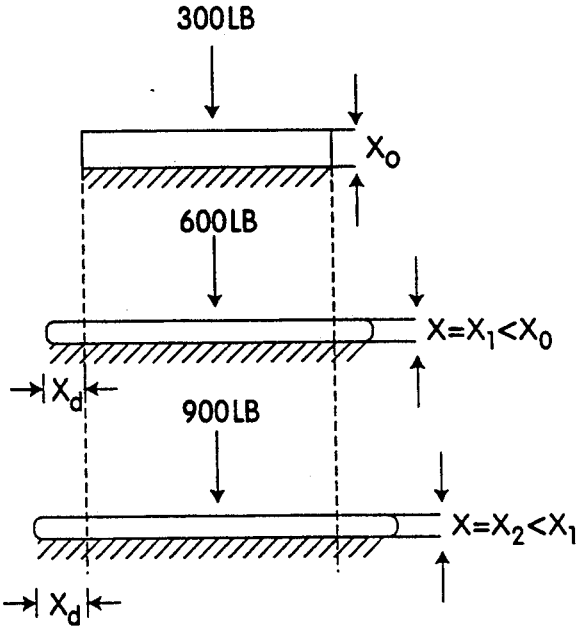
FIG. 18B is a partial cross-sectional view of a sole having a peripheral wall which is able to buckle, the wall height decreasing and the bulge distance increasing proportionally to the applied stresses.

If the peripheral wall of the chamber is made of stretchable material which can give in to pressures exceeding a certain critical level, then an additional room will be formed in the buckled wall for the portion of liquid to move in (see FIG. 18*b*). The value of the critical pressure depends on the wall thickness and on the resistance of wall material. Before the deformation of the peripheral wall takes place, the initial volume of liquid between the chamber ceiling and floor is equal to the floor surface multiplied by the height of the chamber. After the peripheral wall is deformed and the portion of liquid moves into the buckled space, the total volume of liquid apparently remains the same. However a portion of the volume, which was confined between the ceiling and the floor, is diminished by the volume which filled up the space of the buckled wall. Therefore the height of the chamber should diminish.

The chamber ceiling and the floor should never come into immediate contact. Should they come into contact, then the sole "collapses"—the liquid would no more evenly distribute pressures to each square inch of the chamber ceiling. In order to prevent the sole from collapsing the distance between the ceiling and the bottom should not be less than the minimum distance.

In order to find the relationship between the sole parameters, let us assume that the distance between the ceiling and the floor is equal to ¼ of inch. The volume of this sole will be $$12\ in * 4\ in * \tfrac{1}{4}\ in = 12\ in^3.$$

Let us also assume that the depth of cavity, $X_d$, created by a buckled wall at the maximum level of pressure (say 24 psi) is equal to 2 distances between the ceiling and the floor, i.e., $$2 * \tfrac{1}{4}\ in = \tfrac{1}{2}\ in.$$

Then the volume of additional room which is created in the wall for a liquid to flow is equal to the perimeter of the sole $$12\ in + 12\ in + 4\ in + 4\ in = 32\ in$$

multiplied by the new diminished chamber height (which we will represent by X) and by the depth X. of the buckled area. (Here we assume that the form of the buckled area is close to rectangular). We will arrive then at $$V_{bcld} = \tfrac{1}{2}\ in * 32\ in * X\ in = 16X\ in^3.$$

The buckled volume plus the volume of the chamber between ceiling and floor must be equal to the initial volume (12 in$^3$):

$$16X\ \text{in}^3 + 48\ \text{in}^2 * X\ \text{in} = 12\ \text{in}^3$$
or
$$64\ \text{in}^2 * X\ \text{in} = 12\ \text{in}^3$$
or
$$X = 3/16\ \text{in}.$$

This means that the distance between the ceiling and the bottom of said sole chamber has changed only by $$\tfrac{1}{4}\ in - 3/16\ in = 1/16\ in.$$

Since 1/16 inch constitutes 25% of the initial height (¼ inch), it means that this height became 25% less when maximum pressure was generated and the peripheral wall buckled, creating a space the depth of which is equal to two initial distances between the floor and the ceiling.

In general, if initial distance is $X_o$, length of the shoe is L, width is W, new distance is X, and depth $X_d$ of the buckled wall is equal to $kX_o$, where k is coefficient of buckling, then the relative decrease R (in %) of the distance between the ceiling and bottom of the chamber is equal to $$R(\%) = \frac{(X_o - X)}{X_o} * 100\% = \left(1 - \frac{\frac{L}{X_o}}{\frac{L}{X_o} + 8k}\right) * 100\%$$

if we assume that the width W is equal to ⅓ of the length L.

Figure 19:
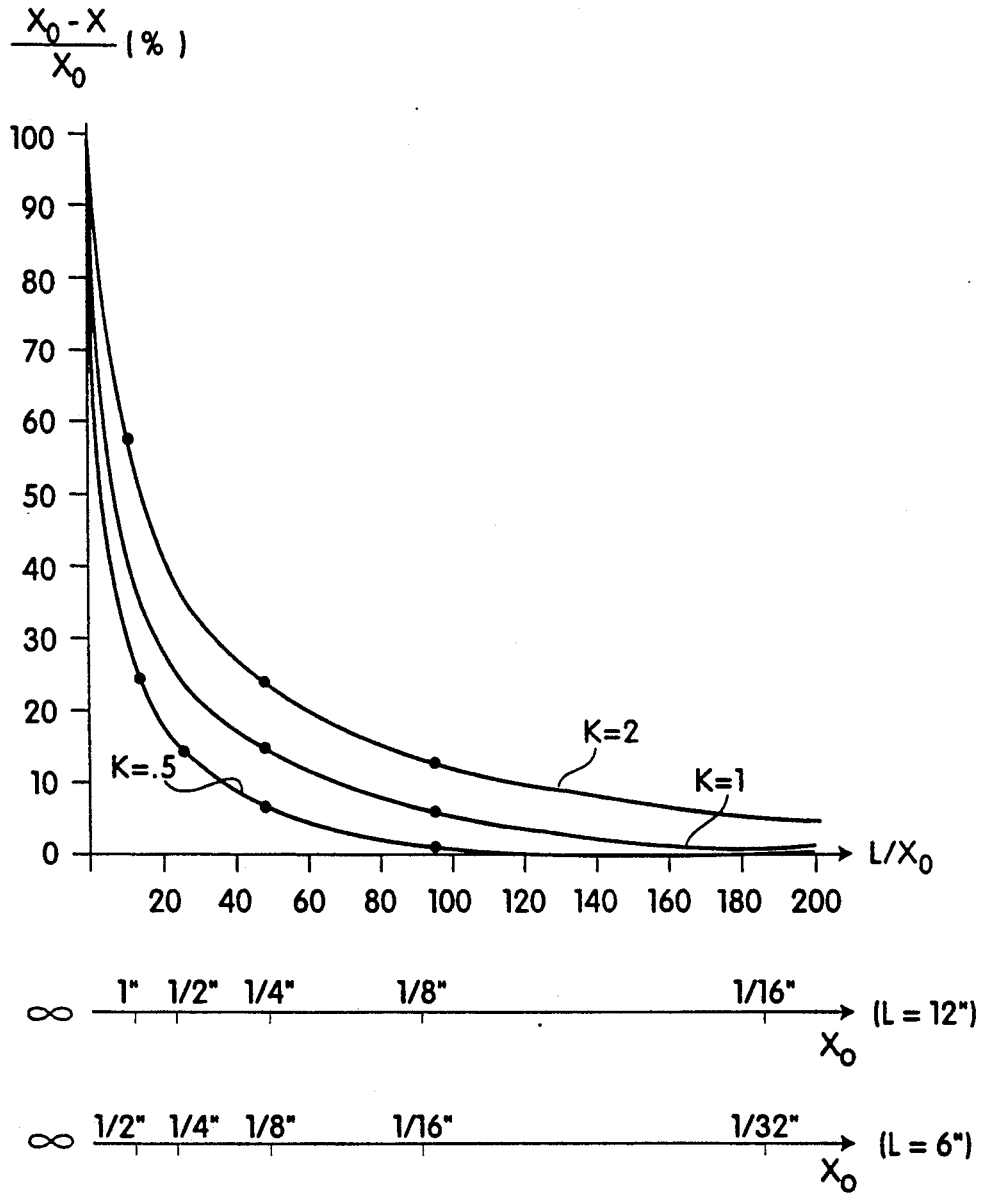
FIG. 19 shoes the dependance of a relative decrease of the chamber height on the ratio of foot length to initial chamber height for different values of the coefficient of buckling.

The dependence of R from $L/X_o$ at different values of the coefficient of buckling k is shown in FIG. 19. A relative drop of the chamber height at a maximum pressure diminishes when the distance between the chamber ceiling and floor decreases, but the coefficient of buckling remains the same.

Two sizes of foot (and sole) length are illustrated in FIG. 19: one size is 12 inches and the other size is 6 inches. Each size has its one axis with the wall height changing from infinity (∞) to 1, 0.5, etc., inches. These heights are marked on the is axis and they correspond to the $L/X_o$ ratio indicated on the horizontal axis of the graph.

The curves of FIG. 19 teach a shoe designer how to create the most efficient embodiment of the present invention. Practice shows that a drop of height exceeding 50% should be avoided in order to escape the "water bed" feeling.

On the other hand, the minimum height of the chamber, and therefore of the layer of fluid, should not be substantially less than 3/16 inch. For example, a 12 inch long shoe with the chamber height $X_o = 3/16$ inch and with the coefficient of buckling k=2 has the relative drop of height equal to 20%, as it follows from FIG. 19. The volume of the chamber will be $$12\ in * 4\ in * 3/16\ in = 9\ in^3$$

or about 150 ml or 5 fluid ounces.

The higher is the chamber wall the larger is the volume of wall material which is engaged in accumulation of kinetic energy, generated by a walker or a jumper. This energy is transformed into potential energy of the deformed springy material. Said potential energy then releases back to the wearer of shoes, when pressures in the chamber subside and the form of the wall restores back to original. Higher distances between ceiling and is bottom are preferable for athletic shoes in which extremely high pressures up to 20–30 psi and more can be generated.

When the wall is higher there is a much wider range of kinds of man-made and natural materials (e.g. different kinds of resins, plastics and rubber), and a wider range of wall thicknesses to choose in order to achieve a better ratio (percentage) of returned kinetic energy to kinetic energy generated by an athlete. Ideally, if none of the generated energy dissipates into heat, the ratio is 100%. The amount of dissipated heat heavily depends on the properties of a material used to build the chamber wall. For instance, materials which yield no or insignificant residual elongation after they were stretched would, as a rule, cause little heat dissipation.

Figure 18C:
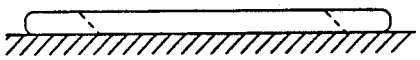
FIG. 18C is a partial cross-sectional view of a sole demonstrating the sliding of the top of the case relative to the bottom due to buckling of the entire peripheral wall.

A large distance between the chamber ceiling and floor may cause a so called "sliding effect" when the ceiling can slide aside from the position where it is located, just above the bottom of the chamber (see FIG. 18c). This phenomenon may more likely happen while walls are being buckled, when a high pressure is generated in the chamber liquid.

Figure 18D:
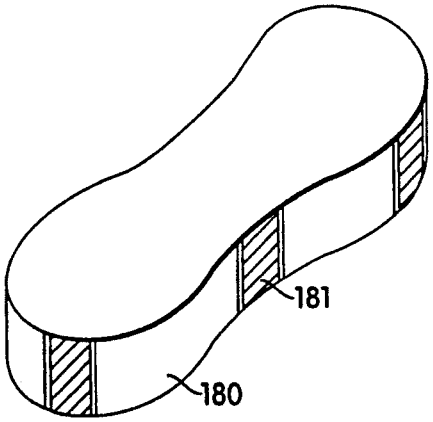
FIG. 18D is a perspective view of the sole according to a further embodiment of the present invention illustrating portions of the peripheral wall which are able to buckle and portions of the peripheral wall which do not buckle and prevent the sole from sliding.

In order to prevent this "sliding effect," walls should be of two kinds—one kind of wall should have the ability to give in when pressures transferred by a liquid exceed the critical level. The other kind of wall should be resistant to deformation at any level of pressure realistically generated inside of the chamber (this pressure ordinarily does not exceed 40–50 psi). The purpose of this kind of wall is to ensure a proper position of the ceiling above the chamber bottom at any pressure level. These unbuckling portions of wall may be located at the front and at the end portions of the chamber as well as on the side portions (see FIG. 18d).

There must be as many unbuckling portions 181 of the wall as it is needed in order to ensure a proper protection against the "sliding" phenomenon, described above.

Figure 20A:
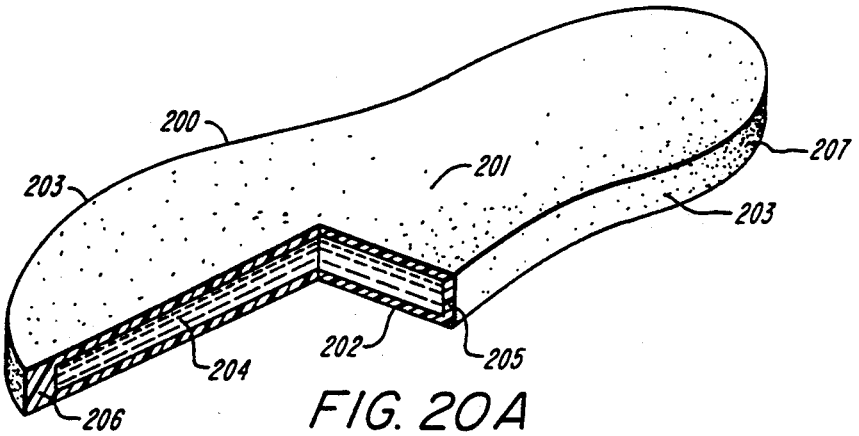
FIG. 20A is a partially cut-away perspective view of a further embodiment of a sole according to the present invention showing a portion of the peripheral wall capable of buckling and a further portion of the peripheral which does not buckle.

One of the embodiments of the sole design, which employs the described above principles, is illustrated by FIGS. 20A and 20B. A sole has a form of a case having a top member 201 for providing afoot receiving surface, a bottom member 202 spaced apart from the top member and generally coextensive therewith, and a peripheral wall 200 connecting the top member to the bottom member at their periphery. The top and bottom members and the peripheral wall define therebetween a chamber 204 for containing a continuous incompressible fluid.

Figure 20B:
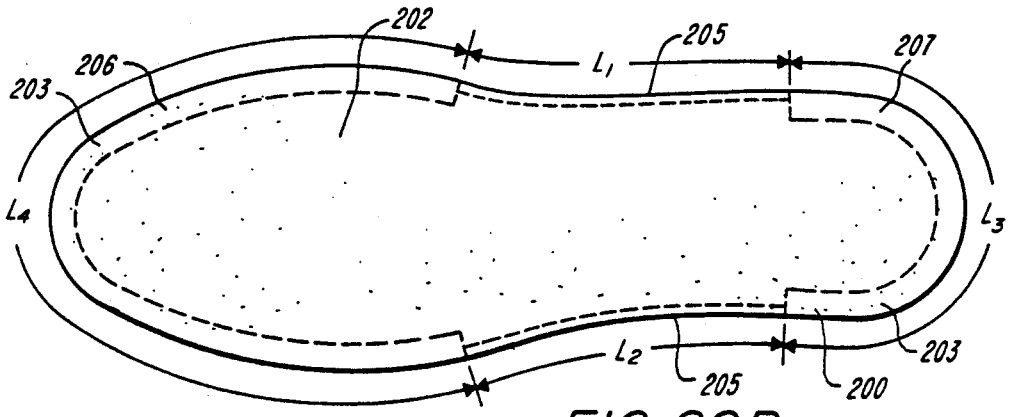
FIG. 20B is a bottom view of the sole of FIG. 20A.

As shown in FIG. 20B, a first portion or component 205 of the peripheral wall is located on both sides of the sole between the toe section 206 and the heel section 207 of the wall. This first or stretchable component 205 is able to buckle from both sides of the sole when pressure inside the chamber 204 exceeds the buckling threshold level (see the area defined by lengths $L_1$ and $L_2$). The toe 206 and the heel 207 sections of the peripheral wall (see the area defined by lengths $L_3$ and $L_4$) define a second portion or component 203. This second or non-stretchable component 203 is resistant to buckling even at a maximum pressure generated by a shoewearer in the fluid.

In this embodiment of the sole construction, the length of the first component 205 is equal to $L_1+L_2$, and the length of the second component 203 is equal to $L_3+L_4$. The most common ratio of $(L_1+L_2)$ to $(L_3+L_4)$ is 1:1. At this ratio, the second component 203 has enough length to provide stability to a sole, thereby preventing the "sliding" phenomenon described above. On the other hand, the first component 205 is still long enough to allow a rather thin wall to be used. A thin wall bulges moderately, storing energy generated by a walker or a jumper without rupturing the wall. At the same time, the thin wall responds to lower levels of applied stresses than does a thicker wall, thus making the sole with a thin wall adaptable to a wider range of applications.

If the ratio is changed in favor of a longer second component 203, say to 1:2, then the anti-sliding ability of the shoe increases, but the length of the buckling first component 205 will diminish, which will require an increase in thickness of the first component 205 to prevent rupturing. This ratio is acceptable for athletic shoes, for example, for a basketball shoe in which both the level of stresses and the energy generated by a player are high, thereby demanding a rather thick stretchable wall.

If the ratio is changed in favor of a longer first component 205, say to 2:1, then the thickness of the first, stretchable component 205 may be diminished, because the energy to be stored by one inch of a stretchable wall is also proportionally diminished. A sole with this ratio will be beneficial, for example, for walking shoes; stresses generated by a walker are relatively small, and thinner walls of the first component will be more responsive to low levels of applied energy in this case.

Two methods are generally used to make he second component of the peripheral wall non-stretchable: 1) change the wall thickness, and 2) change the wall material.

Figure 20C:
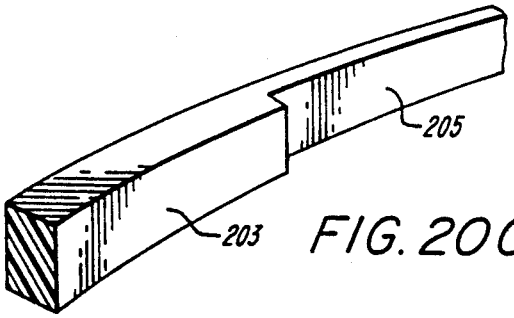
FIG. 20C is a fragmentary perspective view of the peripheral wall of the sole of FIG. 20A showing the interface between the buckling portion and the non-buckling portion.

The first method is illustrated in FIG. 20C, in which a junction area of two components 205 and 203 of the peripheral wall is shown. The first component 205 is able to buckle. The second component 203 is substantially thicker than the first component. A preferred material for both components is EVA (ethylene-vinylacetate), although other suitable materials may be used if desired. The thicker the wall component 203, the less the wall component deforms in response to pressures generated in the fluid, and therefore, less kinetic energy will transform into potential energy of the deformed wall. The potential energy is proportional to the square of the deformation.

Figure 20D:
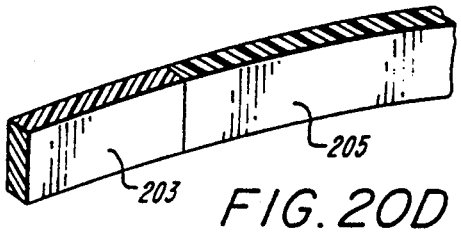
FIG. 20D is a fragmentary perspective view of further embodiment of the present invention showing a peripheral wall formed of two materials having different buckling properties.

The second method is illustrated in FIG. 20D, in which two different materials of the same thickness are shown joined, either by welding or gluing. The Young's modulus of each material differs. The material used for the second component 203 should not buckle at pressure levels up to 30 psi.

Let us define by a coefficient p the ratio between the length of the first component $(L_1+L_2)$ to the perimeter of the sole wall $(L_1+L_2+L_3+L_4)$. Then, for example, a 1:1 ratio of the length of the first component to the length of the second component will correspond to $p=0.5$.

The coefficient p may be incorporated into the formula for calculating the relative drop of height:

FIG. 19 can also be used for this particular case if one assumes that each curve is drawn at $p=1$ (that is, none of the second component is present). If, for example, $p=0.5$, then for $$R(\%) = \left(1 - \frac{\frac{L}{X_o}}{\frac{L}{X_o} + 8kp}\right) * 100\%$$

$k=2$, we need to use the curve with $k * 0.5=1$, and so on. This means that in the example considered above of a 12 inch shoe, the relative drop of height will diminish to 11% from 20% if p changes from 1 to 0.5.

Figure 20E:
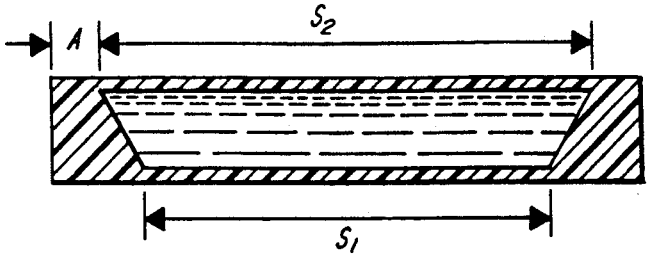
FIG. 20E is a cross-sectional view of a further embodiment of the sole of the present invention which illustrates force magnification.
Figure 20F:
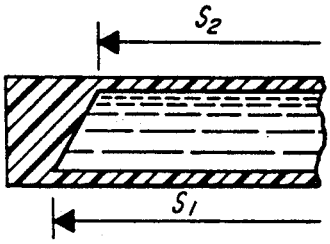
FIG. 20F is a partial cross-sectional view of a still further embodiment of the present invention which illustrates force attentuation.

FIGS. 20E, 20F, 20J, and 20K illustrate a further embodiment of the invention, in which the second, non-stretchable component 203 of the peripheral wall is trapezoidal in cross-section, whereby the wall thickness varies along the distance between the top member 201 and bottom member 202, and the first, stretchable component 205 is rectangular in cross-section. The trapezoidal cross section of the second component 203 provides that the surface area $S_1$ which contacts the ground differs from the surface area $S_2$ which contacts the weight-bearing portion of the plantar surface of a foot. The chamber 204 between these different surface areas is filled with an incompressible fluid. According to Pascal's principle, by which the pressure exerted on the fluid by external forces is transmitted equally in all directions, the difference in surface areas thus leads to a magnification (when $S_2$ exceeds $S_2$ as shown in FIG. 20E) or attenuation (when $S_2$ exceeds $S_1$, as shown in FIG. 20F) of the force $F_2$ applied to a wearer due to the force $F_1$ exerted by the ground which contacts the sole. The degree of force magnification or force attenuation depends on the ratio between $S_2$ and $S_1$.

The embodiment of a sole construction described above thus combines the force magnification/attenuation property with the energy storing and returning property of the sole. The first property is provided by the difference between $S_2$ and $S_1$, the latter property by the first component of the peripheral wall which is able to buckle. If small side A of the trapezoid (shown in FIG. 20E) has the same wall thickness as the wall of the first component (see FIGS. 20H and 20J) and if both wall components are made of the same material, then the side A area will also buckle, thus contributing even more to the energy storing and returning property of the sole. Moreover, buckling in the side A area will increase surface area $S_2$, as shown in FIG. 20E, or will increase surface area $S_1$, as shown in FIG. 20F, further contributing to the force magnification/attenuation property of the sole.

Figure 20G:
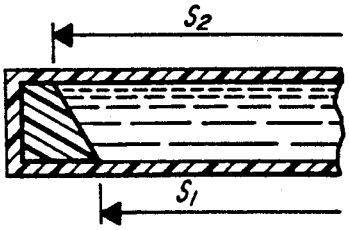
FIG. 20G is a partial cross-sectional view of a still further embodiment of the present invention which illustrates the insert used to acheive a trapezoidal form of the second component of the peripheral wall.
Figure 20H:
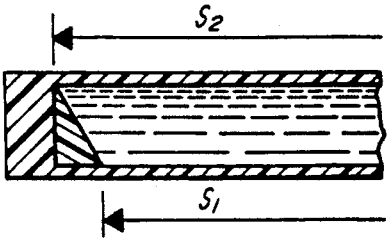
FIG. 20H is a partial cross-sectional view of a still further embodiment of the present invention which illustrates an insert providing the thickness at the top of the second component flush with the thickness of the first component.
Figure 20J:
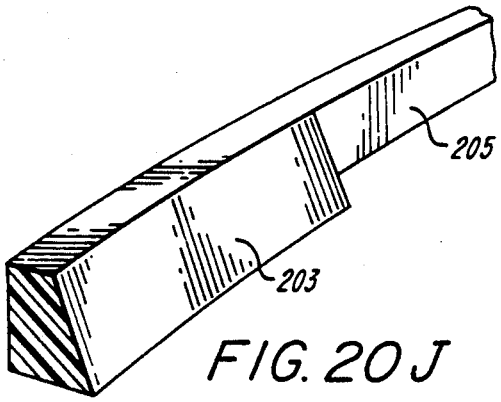
FIG. 20J is a fragmentary perspective view of the peripheral wall of the sole of FIG. 20E showing the interface between the buckling portion and the non-buckling portion.
Figure 20K:
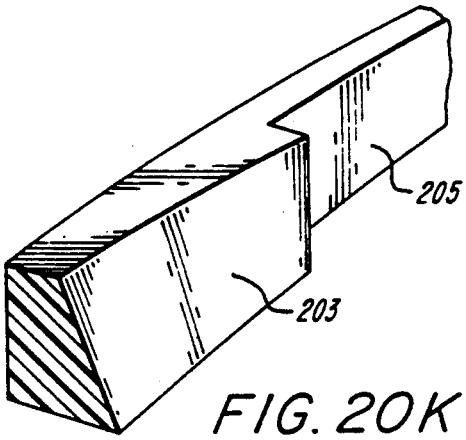
FIG. 20K is a fragmentary perspective view of a further embodiment of the peripheral wall of the sole showing the interface between the buckling portion and the non-buckling portion.

The trapezoidal cross-section of the second component of the peripheral wall can be formed during the process of molding the sole if the first and the second components of the peripheral wall are made of the same material (see FIG. 20G). In a further embodiment of the invention, an insert 207 (FIGS. 20G or 20H), which creates the trapezoidal cross-section, is glued or welded along that area of the peripheral wall which should function as the second component. The insert can be made of a material which is different form the material used to form the sole and the first component of the wall.

The invention is not to be limited by what has been particularly shown and described, except as indicated in the appended claims.

We claim:

1. A sole comprising:

a case having a top member for providing a foot receiving surface, a bottom member spaced apart from said top member and generally coextensive therewith, a peripheral wall connecting said top member to said bottom member at their periphery and defining between said top member and said bottom member and within said peripheral wall a chamber for containing a continuous incompressible fluid;

at least one portion of said peripheral wall, defining a first component of the wall, being formed with a first constant thickness between said top member and said bottom member, whereby said first component is able to buckle when pressure inside said chamber exceeds a predetermined pressure level; and the rest of said peripheral wall, defining a second component of the wall, being formed with a second constant thickness between said top member and said bottom member, said second thickness being greater than said first constant thickness, whereby said second component is resistant to buckling at pressure levels which cause said first component of the wall to buckle.

2. A sole of claim 1 wherein the minimum height of said peripheral wall is approximately three sixteenths (3/16) of an inch.

3. A sole of claim 1 wherein the second component of said peripheral wall is located along the toe and the heel sections of the sole, and the first component of the peripheral wall is located along the side section between the heel and toe sections on both sides of the sole.

4. A sole of claim 3 wherein the ratio between the total lengths of the first and the second components of the peripheral wall is in the range of 1:2 to at least 2:1.

5. A sole of claim 1 wherein the second component of the peripheral wall has a thickness greater than the thickness of the wall of the first component such that the second component does not buckle at a pressure level of 30 psi.

6. The sole of claim 1 wherein the maximum predetermined buckling pressure level is 30 pounds per square inch.

7. The shoe sole of claim 5, wherein the first component and the second component are formed from the same material.

8. A shoe sole comprising:

a case having a bottom portion for contacting the ground, a top portion for contacting the plantar surface of a foot, and a peripheral wall connecting the top portion to the bottom portion along the edges of the top and bottom portions, the top and bottom portions and the peripheral wall thereby defining a chamber;

an incompressible liquid within the chamber, whereby the liquid provides an even distribution of pressure within the chamber; and the peripheral wall being formed of a first component and a second component, the second component being tapered between the top portion and the bottom portion to provide a plurality of wall thicknesses, the first component having a wall thickness which is less than most of the plurality of wall thicknesses of the second component, whereby the first component is capable of buckling at a predetermined pressure generated in the liquid in the chamber, and the second component is capable of resisting buckling at the predetermined pressure.

9. The shoe sole of claim 8, wherein the bottom portion has a first surface area under the liquid for contacting the ground and the top portion has a second surface area over the liquid for contacting the plantar area of the foot which is different from the first surface area of the bottom portion.

10. The shoe sole of claim 9, wherein the first surface area of the bottom portion is greater than the second surface area of the top portion, thereby providing an attenuation of the force applied to the weight-bearing portion of the plantar area of the foot as compared to the force applied by the ground to the first surface area at the bottom portion of the sole.

11. The shoe sole of claim 9, wherein the first surface area of the bottom portion is less than the second surface area of the top portion, thereby providing a magnification of the force applied to the weight-bearing portion of the plantar area of the foot as compared to the force applied by the ground to the first surface area at the bottom portion of the sole.

12. The shoe sole of claim 9, wherein the difference in surface area is provided by forming the second component of the peripheral wall portion with the tapering plurality of thicknesses between the top portion and the bottom portion.

13. The sole of claim 12, wherein the tapering plurality of thicknesses between the top portion and the bottom portion is formed with the help of at least one solid insert which is attached to those untapered portions of the peripheral wall which will function as the unstretchable second component.

14. The sole of claim 13, wherein said second wall component tapers to the thickness of said first wall component.

15. The sole of claim 13, wherein the tapering thickness of the insert reaches such a thickness at the narrow side which combined with the thickness of the peripheral wall can withstand pressure of 30 psi without buckling.

16. The shoe sole of claim 8, wherein the predetermined pressure at which the first component buckles is 30 psi.

17. The shoe sole of claim 8, wherein the first component is formed along the sides of the sole and the second component is formed along the toe and heel sections of the sole.

18. The shoe sole of claim 8, wherein the liquid fills the entire chamber.

19. The shoe sole of claim 8, wherein the bottom portion has a first surface area for contacting the ground and the top portion has a second surface area for contacting the plantar area of the foot which is different from the first surface area of the bottom portion.

20. The shoe sole of claim 19, wherein the first surface area of the bottom portion is greater than the second surface area of the top portion, thereby providing an attenuation of the force applied to the weight-bearing portion of the plantar area of the foot as compared to the force applied by the ground to the first surface area at the bottom portion of the sole.

21. The shoe sole of claim 19, wherein the first surface area of the bottom portion is less than the second surface area of the top portion, thereby providing a magnification of the force applied to the weight-bearing portion of the plantar area of the foot as compared to the force applied by the ground to the first surface area at the bottom portion of the sole.

22. The shoe sole of claim 8, wherein the height of the peripheral wall is no less than approximately three sixteenths (3/16) of an inch.

23. The shoe sole of claim 8, wherein the ratio of the length of the first component of the peripheral wall extending about the circumference of the sole to the length of the second component of the peripheral wall extending about the circumference of the sole is within the range of 1:2 to 2:1.

24. A shoe sole comprising:

a case having a bottom portion for contacting the ground, a top portion for contacting the plantar surface of a foot, and a peripheral wall connecting the top portion to the bottom portion along the edges of the top and bottom portions, the top and bottom portions and the peripheral wall thereby defining a chamber;

an incompressible liquid within the chamber, whereby the liquid provides an even distribution of pressure within the chamber; and the peripheral wall being formed of a first component and a second component, the first component being formed of a first material having a first Young's modulus of elasticity and the second component being formed of a second material having a second Young's modulus of elasticity which is greater than the first Young's modulus of elasticity, whereby the first component is capable of buckling at a predetermined pressure generated in the liquid in the chamber, and the second component is capable of resisting buckling at the predetermined pressure.

25. A shoe sole comprising:

a case having a bottom portion for contacting the ground, a top portion for contacting the plantar surface of a foot, and a peripheral wall connecting the top portion to the bottom portion along the edges of the top and bottom portions, the top and bottom portions and the peripheral wall thereby defining a chamber;

an incompressible liquid within the chamber, whereby the liquid provides an even distribution of pressure within the chamber; and the peripheral wall being formed of a first component and a second component, the first component being formed from a different material from the second wall component, whereby the first component is capable of buckling at a predetermined pressure generated in the liquid in the chamber, and the second component is capable of resisting buckling at the predetermined pressure.

26. A sole comprising:

a case having a top member for providing a foot receiving surface, a bottom member spaced apart from said top member and generally coextensive therewith, a peripheral wall connecting said top member to said bottom member at their periphery and defining between said top member and said bottom member and within said peripheral wall a chamber for containing a continuous incompressible fluid;

at least one portion of said peripheral wall, defining a first component of the wall, made of a first material which buckles at pressures inside said chamber below 30 psi; and the rest of said peripheral wall, defining a second component of the wall, made of a second material which substantially does not buckle at pressures inside said chamber below 30 psi.

27. A sole comprising:

a case having a top member for providing a foot receiving surface, a bottom member spaced apart from said top member and generally coextensive therewith, a peripheral wall connecting said top member to said bottom member at their periphery and defining between said top member and said bottom member and within said peripheral wall a chamber for containing a continuous incompressible fluid;

at least one portion of said peripheral wall, defining a first component of the wall, being formed with a first constant thickness between the top member and the bottom member, whereby said first component is able to buckle when pressure inside said chamber exceeds a predetermined pressure level; and the rest of said peripheral wall, defining a second component of the wall, being tapered between the top member and the bottom member to provide a plurality of wall thicknesses, most of said plurality of wall thicknesses being greater than said first thickness of said first component, whereby said second component is resistant to buckling at pressure levels which cause said first component of the wall to buckle.

* * * * *

UNITED STATES PATENT AND TRADEMARK OFFICE

CERTIFICATE OF CORRECTION

PATENT NO. : 5,283,963

DATED : February 8, 1994

INVENTOR(S) : Moisey Lerner, et al.

It is certified that error appears in the above-indentified patent and that said Letters Patent is hereby corrected as shown below:

Column 1, line 12, "1. Field of the Invention", should be a heading, centered and in all caps as follows:
--FIELD OF THE INVENTION--

Column 1, line 18, "2. Background of the Invention" should be a heading, centered and in all caps as follows:
--BACKGROUND OF THE INVENTION--

Column 6, line 38, "container, said" should read -- ontainer. Said--.

Column 8, line 35, "resilience. said" should read --resilience. Said--.

Column 8, line 55, "a sur face" should read --a surface--.

Column 9, line 9, "which iS" should read --which is--.

Column 9, line 9, "tines" should read --times--.

Column 9, line 29, "sur face" should read --surface--.

Column 12, line 2, "conditions, said" should read --conditions. Said--.

Column 13, line 48, "X. of" should read --$X_d$ of--.

Column 14, line 58, "and is" should read --and--.

UNITED STATES PATENT AND TRADEMARK OFFICE

CERTIFICATE OF CORRECTION

PATENT NO. : 5,283,963

DATED : February 8, 1994

INVENTOR(S) : Moisey Lerner, et al.

It is certified that error appears in the above-indentified patent and that said Letters Patent is hereby corrected as shown below:

Column 19, line 4, "portion" should read --member--.

Column 17, line 13, exceeds $S_2$" should read --exceeds $S_1$--.

Signed and Sealed this

Seventh Day of February, 1995

*Attest:*

Bruce Lehman

BRUCE LEHMAN

*Attesting Officer*

*Commissioner of Patents and Trademarks*